US006409316B1

(12) United States Patent
Clark et al.

(10) Patent No.: US 6,409,316 B1
(45) Date of Patent: Jun. 25, 2002

(54) THERMAL INK JET PRINTHEAD WITH CROSSLINKED POLYMER LAYER

(75) Inventors: Shan C. Clark, Webster; Thomas W. Smith, Penfield, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/536,803

(22) Filed: Mar. 28, 2000

(51) Int. Cl.[7] ..... B41J 2/05
(52) U.S. Cl. ..... 347/63
(58) Field of Search ..... 347/63, 56, 54, 347/20

(56) References Cited

U.S. PATENT DOCUMENTS

| | | | | | |
|---|---|---|---|---|---|
| 4,882,245 | A | | 11/1989 | Gelorme et al. | 430/14 |
| 5,026,624 | A | | 6/1991 | Day et al. | 430/280 |
| 5,243,363 | A | * | 9/1993 | Koizumi et al. | 347/50 |
| 5,278,010 | A | | 1/1994 | Day et al. | 430/18 |
| 5,304,457 | A | | 4/1994 | Day et al. | 430/280 |
| 5,335,004 | A | | 8/1994 | Matsuhisa | 347/44 |
| 5,578,417 | A | | 11/1996 | Noguchi et al. | 430/280.1 |
| 5,736,619 | A | * | 4/1998 | Kane et al. | 523/393 |
| 5,745,131 | A | * | 4/1998 | Kneezel et al. | 347/15 |
| 5,762,812 | A | | 6/1998 | Narang | 216/27 |
| 5,774,151 | A | * | 6/1998 | Sugitani et al. | 347/63 |
| 5,859,655 | A | | 1/1999 | Gelorme et al. | 347/65 |
| 5,877,229 | A | * | 3/1999 | Janke et al. | 522/31 |
| 5,907,333 | A | | 5/1999 | Patil et al. | 347/20 |
| 5,945,253 | A | | 8/1999 | Narang et al. | 430/280.1 |
| 6,022,095 | A | * | 2/2000 | Narang et al. | 347/54 |
| 6,124,372 | A | | 9/2000 | Smith et al. | 522/35 |
| 6,139,920 | A | | 10/2000 | Smith et al. | 427/510 |

FOREIGN PATENT DOCUMENTS

| | | |
|---|---|---|
| EP | 0 921 141 A1 | 6/1999 |
| WO | WO 98/07069 | 2/1998 |

* cited by examiner

*Primary Examiner*—John Barlow
*Assistant Examiner*—Michael S Brooke
(74) *Attorney, Agent, or Firm*—Judith L. Byorick

(57) ABSTRACT

A thermal ink jet printhead having an upper substrate and a lower substrate in which one surface thereof has an array of heating elements and addressing electrodes formed thereon. The lower substrate has an insulative layer deposited on the surface thereof and over the heating elements and addressing electrodes and patterned to form recesses therethrough to expose the heating elements and terminal ends of the addressing electrodes. The upper and lower substrates are bonded together to form a thermal ink jet printhead having droplet emitting nozzles defined by the upper substrate, the insulative layer on the lower substrate, and the heating elements in the lower substrate. At least one of the upper substrate and the insulative layer comprises a crosslinked polymer formed by crosslinking a precursor polymer which is a phenolic novolac resin having glycidyl ether functional groups on the monomer repeat units thereof.

33 Claims, 7 Drawing Sheets

THERMAL INK JET PRINTHEAD WITH CROSSLINKED POLYMER LAYER

BACKGROUND OF THE INVENTION

The present invention is directed to printheads useful for thermal ink jet printing processes. More specifically, the present invention is directed to thermal ink jet printheads having advantages such as improved ink resistance and channel and nozzle features with improved aspect ratio. One embodiment of the present invention is directed to a thermal ink jet printhead which comprises: (i) an upper substrate, and (ii) a lower substrate in which one surface thereof has an array of heating elements and addressing electrodes formed thereon, said lower substrate having an insulative layer deposited on the surface thereof and over the heating elements and addressing electrodes and patterned to form recesses therethrough to expose the heating elements and terminal ends of the addressing electrodes, said upper and lower substrates being bonded together to form a thermal ink jet printhead having droplet emitting nobles defined by the upper substrate, the insulative layer on the lower substrate, and the heating elements in the lower substrate, wherein at least one of said upper substrate and said insulative layer comprises a crosslinked polymer formed by crosslinking a precursor polymer which is a phenolic novolac resin having glycidyl ether functional groups on the monomer repeat units thereof. Another embodiment of the present invention is directed to a process for forming a thermal ink jet printhead which comprises: (a) providing a lower substrate in which one surface thereof has an array of heating elements and addressing electrodes having terminal ends formed thereon; (b) depositing onto the surface of the lower substrate having the heating elements and addressing electrodes thereon a layer comprising a precursor polymer which is a phenolic novolac resin having glycidyl ether functional groups on the monomer repeat units thereof, (c) exposing the layer to actinic radiation in an imagewise pattern such that the precursor polymer in exposed areas becomes a crosslinked polymer and the precursor polymer in unexposed areas does not become crosslinked, wherein the unexposed areas correspond to areas of the lower substrate having thereon the heating elements and the terminal ends of the addressing electrodes; (d) removing the precursor polymer from the unexposed areas, thereby forming recesses in the layer, said recesses exposing the heating elements and the terminal ends of the addressing electrodes; (e) providing an upper substrate; and (f) bonding the upper substrate to the lower substrate to form a thermal ink jet printhead having droplet emitting nozzles defined by the upper substrate, the crosslinked polymer on the lower substrate, and the heating elements in the lower substrate.

In microelectronics applications, there is a great need for low dielectric constant, high glass transition temperature, thermally stable, photopatternable polymers for use as interlayer dielectric layers and as passivation layers which protect microelectronic circuitry. Poly(imides) are widely used to satisfy these needs; these materials, however, have disadvantageous characteristics such as relatively high water sorption and hydrolytic instability. There is thus a need for high performance polymers which can be effectively photopatterned and developed at high resolution.

One particular application for such materials is the fabrication of ink jet printheads. Ink jet printing systems generally are of two types: continuous stream and drop-on-demand. In continuous stream ink jet systems, ink is emitted in a continuous stream under pressure through at least one orifice or nozzle. The stream is perturbed, causing it to break up into droplets at a fixed distance from the orifice. At the break-up point, the droplets are charged in accordance with digital data signals and passed through an electrostatic field which adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium.

Since drop-on-demand systems require no ink recovery, charging, or deflection, the system is much simpler than the continuous stream type. One type of drop-on-demand system has as its major components an ink filled channel or passageway having a nozzle on one end and a piezoelectric transducer near the other end to produce pressure pulses. The relatively large size of the transducer prevents close spacing of the nozzles, and physical limitations of the transducer result in low ink drop velocity. Low drop velocity seriously diminishes tolerances for drop velocity variation and directionality, thus impacting the system's ability to produce high quality copies.

Another type of drop-on-demand system is known as thermal ink jet or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble. The ink at the orifice is forced out as a propelled droplet as the bubble expands. When the hydrodynamic motion of the ink stops, the process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

The operating sequence of the bubble jet system begins with a current pulse through the resistive layer in the ink filled channel, the resistive layer being in close proximity to the orifice or nozzle for that channel. Heat is transferred from the resistor to the ink. The ink becomes superheated far above its normal boiling point, and for water based ink, finally reaches the critical temperature for bubble formation or nucleation of around 280° C. Once nucleated, the bubble or water vapor thermally isolates the ink from the heater and no further heat can be applied to the ink. This bubble expands until all the heat stored in the ink in excess of the normal boiling point diffuses away or is used to convert liquid to vapor, which removes heat due to heat of vaporization. The expansion of the bubble forces a droplet of ink out of the nozzle, and once the excess heat is removed, the bubble collapses on the resistor. At this point, the resistor is no longer being heated because the current pulse has passed and, concurrently with the bubble collapse, the droplet is propelled at a high rate of speed in a direction towards a recording medium. The resistive layer encounters a severe cavitational force by the collapse of the bubble, which tends to erode it. Subsequently, the ink channel refills by capillary action. This entire bubble formation and collapse sequence occurs in about 10 microseconds. The channel can be refired after 100 to 500 microseconds minimum dwell time to enable the channel to be refilled and to enable the dynamic refilling factors to become somewhat dampened. Thermal ink jet processes are well known and are described in, for example, U.S. Pat. Nos. 4,601,777, 4,251,824, 4,410,899, 4,412,224, and 4,532,530, the disclosures of each of which are totally incorporated herein by reference.

The present invention is suitable for thermal ink jet printing processes.

In ink jet printing, a printhead is usually provided having one or more ink-filled channels communicating with an ink supply chamber at one end and having an opening at the opposite end, referred to as a nozzle. These printheads form images on a recording medium such as paper by expelling droplets of ink from the nozzles onto the recording medium. The ink forms a meniscus at each nozzle prior to being expelled in the form of a droplet. After a droplet is expelled, additional ink surges to the nozzle to reform the meniscus.

In thermal ink jet printing, a thermal energy generator, usually a resistor, is located in the channels near the nozzles a predetermined distance therefrom. The resistors are individually addressed with a current pulse to momentarily vaporize the ink and form a bubble which expels an ink droplet. As the bubble grows, the ink bulges from the nozzle and is contained by the surface tension of the ink as a meniscus. The rapidly expanding vapor bubble pushes the column of ink filling the channel towards the nozzle. At the end of the current pulse the heater rapidly cools and the vapor bubble begins to collapse. However, because of inertia, most of the column of ink that received an impulse from the exploding bubble continues its forward motion and is ejected from the nozzle as an ink drop. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a recording medium, such as paper.

Ink jet printheads include an array of nozzles and may, for example, be formed of silicon wafers using orientation dependent etching (ODE) techniques. The use of silicon wafers is advantageous because ODE techniques can form structures, such as nozzles, on silicon wafers in a highly precise manner. Moreover, these structures can be fabricated efficiently at low cost. The resulting nozzles are generally triangular in cross-section. Thermal ink jet printheads made by using the above-mentioned ODE techniques typically comprise a cover or channel plate which contains a plurality of nozzle-defining channels located on a lower surface thereof bonded to a heater plate having a plurality of resistive heater elements formed on an upper surface thereof and arranged so that a heater element is located in each channel. The upper surface of the heater plate typically includes an insulative layer which is patterned to form recesses exposing the individual heating elements. This insulative layer is referred to as a "pit layer" and is sandwiched between the cover or channel plate and heater plate. For examples of printheads employing this construction, see U.S. Pat. Nos. 4,774,530 and 4,829,324, the disclosures of each of which are totally incorporated herein by reference. Additional examples of thermal ink jet printheads are disclosed in, for example, U.S. Pat. Nos. 4,835,553, 5,057,853, and 4,678,529, the disclosures of each of which are totally incorporated herein by reference. Alternatively, the cover plate can be flat, without any nozzle-defining channels therein, and the channel or nozzle walls can be defined by the recesses in the insulative layer.

U.S. Pat. No. 5,762,812 (Narang), the disclosure of which is totally incorporated herein by reference, discloses a thermal ink jet printhead which comprises (a) an upper substrate with a set of parallel grooves for subsequent use as ink channels and a recess for subsequent use as a manifold, the grooves being open at one end for serving as droplet emitting nozzles; and (b) a lower substrate in which one surface thereof has an array of heating elements and addressing electrodes formed thereon, the lower substrate having a thick film insulative layer deposited over the heating elements and addressing electrodes and patterned to form recesses therethrough to expose the heating elements and terminal ends of the addressing electrodes; said upper and lower substrates being aligned, mated, and bonded together to form the printhead with the grooves in the upper substrate being aligned with the heating elements in the lower substrate to form droplet emitting nozzles, wherein the upper and lower substrates are bonded together with an adhesive which comprises a reaction product of (a) an epoxy resin selected from the group consisting of (1) those of the formula

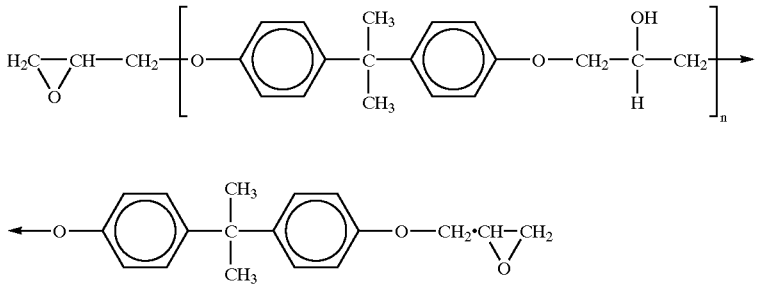

wherein n is an integer of from 1 to about 25; (2) those of the formula

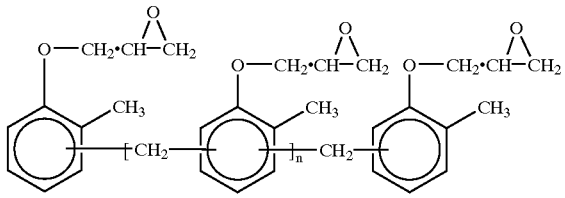

wherein n is an integer of from 1 to about 25; (3) those of the formula

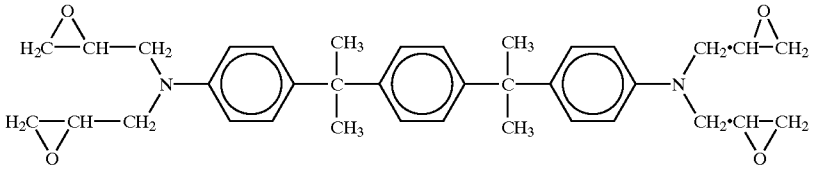

and (4) mixtures thereof; and (b) a curing agent which enables substantial curing of the epoxy resin at a temperature of not lower than the softening point of the resin and not higher than about 20° C. above the softening point of the resin within a period of no more than about 3 hours. Also disclosed are processes for preparing a thermal ink jet printhead with the aforementioned adhesive components.

U.S. Pat. No. 5,945,253 (Narang et al.), the disclosure of which is totally incorporated herein by reference, discloses a composition which comprises a polymer containing at least some monomer repeat units with photosensitivity-imparting substituents which enable crosslinking or chain extension of the polymer upon exposure to actinic radiation, said polymer being of the formula

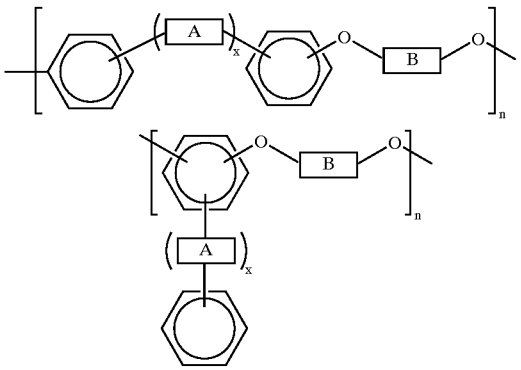

or wherein x is an integer of 0 or 1, A is one of several specified groups, such as

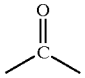

B is one of several specified groups, such as

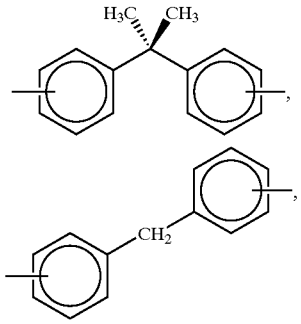

-continued

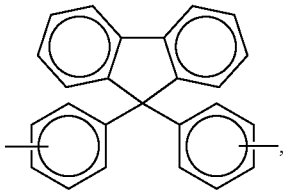

or mixtures thereof, and n is an integer representing the number of repeating monomer units, wherein said photosensitivity-imparting substituents are allyl ether groups, epoxy groups, or mixtures thereof. Also disclosed are a process for preparing a thermal ink jet printhead containing the aforementioned polymers and processes for preparing the aforementioned polymers.

U.S. Pat. No. 4,882,245 (Gelorme et al.), the disclosure of which is totally incorporated herein by reference, discloses a photocurable composition which is useful as a permanent resist in the manufacture of printed circuit boards and packages of such boards comprises a multifunctional epoxidized resin, a reactive diluent, a cationic photoinitiator, and, optionally, an exposure indicator, a coating aid and a photosensitizer.

U.S. Pat. No. 5,026,624 (Day et al.), U.S. Pat. No. 5,278,010 (Day et al.), and U.S. Pat. No. 5,304,457 (Day et al.), the disclosures of each of which are totally incorporated herein by reference, disclose an improved photoimagable cationically polymerizable epoxy based coating material. The material includes an epoxy resin system consisting essentially of between about 10 percent and about 80 percent by weight of a polyol resin which is a condensation product of epichlorohydrin and bisphenol A having a molecular weight of between about 40,000 and 130,000; between about 20 percent and about 90 percent by weight of an epoxidized octafunctional bisphenol A formaldehyde novolak resin having a molecular weight of 4,000 to 10,000; and if flame retardancy is required between about 35 percent and 50 percent by weight of an epoxidized glycidyl ether of tetrabromo bisphenol A having a softening point of between about 60° C. and about 110° C. and a molecular weight of between about 600 and 2,500. To this resin system is added about 0.1 to about 15 parts by weight per 100 parts of resin of a cationic photoinitiator capable of initiating polymerization of said epoxidized resin system upon exposure to actinic radiation; the system being further characterized by having an absorbance of light in the 330 to 700 nanometer region of less than 0.1 for a 2.0 mil thick film. Optionally a photosensitizer such as perylene and its derivatives or anthracene and its derivatives may be added.

U.S. Pat. No. 5,859,655 (Gelorme et al.), the disclosure of which is totally incorporated herein by reference, discloses an ink jet printer head formed from a photoimageable organic material. This material provides for a spin-on epoxy based photoresist with image resolution and adhesion to hard to bond to metals such as gold or tantalum/gold surfaces that are commonly found in such printer applications. When cured, the material provides a permanent photoimageably defined pattern in thick films (>30) that has chemical (i.e. high pH inks) and thermal resistance.

U.S. Pat. No. 5,907,333 (Patil et al.), the disclosure of which is totally incorporated herein by reference, discloses an ink jet printhead having ink passageways formed in a radiation cured resin layer which is attached to a substrate. The passageways are connected in fluid flow communication to an ink discharging outlet provided by an orifice plate. To form the passageways in the resin layer, a resin composition is exposed to a radiation source in a predetermined pattern to cure certain regions of resin layer while other regions which provide the passageways remain uncured. The uncured regions are removed from the resin layer leaving the desired passageways. The resin composition to be used for forming the radiation curable layers is a resin composition comprising a first multifunctional epoxy compound, a second multifunctional compound, a photoinitiator, and a non-photoreactive solvent.

WO98/07069 (Mastrangelo et al.), the disclosure of which is totally incorporated herein by reference, discloses polymer-based microelectomechanical system (MEMS) technology suitable for the fabrication of integrated microfluidic systems, particularly medical and chemical diagnostics system, ink jet printer head, as well as any devices that require liquid- or gas-filled cavities for operation. The integrated microfluidic systems may consist of pumps, valves, channels, reservoirs, cavities, reaction chambers, mixers, heaters, fluidic interconnects, diffusers, nozzles, and other microfluidic components on top of a regular circuit substrate. The technology is superior to alternatives such as glass-based, polysilicon-based MEMS technology as well as hybrid "circuit board" technology because of its simple construction, low cost, low temperature processing, and ability to integrate any electronic circuitry easily along with the fluidic parts.

U.S. Pat. No. 6,124,372 (Smith et al.), the disclosure of which is totally incorporated herein by reference, discloses a composition comprising a polymer with a weight average molecular weight of from about 1,000 to about 100,000, said polymer containing at least some monomer repeat units with a first, photosensitivity-imparting substituent which enables crosslinking or chain extension of the polymer upon exposure to actinic radiation, said polymer also containing a second, thermal sensitivity-imparting substituent which enables further crosslinking or chain extension of the polymer upon exposure to temperatures of about 140° C. and higher, wherein the first substituent is not the same as the second substituent, said polymer being selected from the group consisting of polysulfones, polyphenylenes, polyether sulfones, polyimides, polyamide imides, polyarylene ethers, polyphenylene sulfides, polyarylene ether ketones, phenoxy resins, polycarbonates, polyether imides, polyquinoxalines, polyquinolines, polybenzimidazoles, polybenzoxazoles, polybenzothiazoles, polyoxadiazoles, copolymers thereof, and mixtures thereof.

U.S. Pat. No. 6,139,920 (Smith et al.), the disclosure of which is totally incorporated herein by reference, discloses a composition comprising a blend of (a) a thermally reactive polymer selected from the group consisting of resoles, novolacs, thermally reactive polyarylene ethers, and mixtures thereof; and (b) a photoreactive epoxy resin that is photoreactive in the absence of a photocationic initiator. Also disclosed is a thermal ink jet printhead prepared with the composition.

In the fabrication of sideshooter-type printhead elements, the fluidic pathway is often defined by a photopatternable polyimide negative photoresist. Polyimides provide thermally stable structures and possess good adhesion. Polyimides, however, are not ideal because of their frequent hydrolytic instability in alkaline aqueous media and because of the high shrinkage (sometimes up to about 40 percent) observed for features during final cure caused by the imidization process. Accordingly, there is a need for chemically stable, hydrolytically stable, and solvent resistant negative resists for sideshooter ink jet printheads. As the sideshooter ink jet printhead has evolved, a need has also arisen for resist materials that can be patterned at high aspect ratio and that do not suffer from loss of resolution through shrinkage.

While known compositions and processes are suitable for their intended purposes, a need remains for improved sideshooter thermal ink jet printheads. In addition, a need remains for sideshooter thermal ink jet printheads that contain chemically stable materials. Further, a need remains for sideshooter thermal ink jet printheads that are hydrolytically stable in aqueous media, particularly alkaline aqueous media. Additionally, a need remains for sideshooter thermal ink jet printheads that are formed of photopatternable materials that exhibit low shrinkage upon curing. There is also a need for sideshooter thermal ink jet printheads that are solvent resistant. In addition, there is a need for sideshooter thermal ink jet printheads that can be patterned at high aspect ratio and that do not suffer from loss of resolution through shrinkage. Further, there is a need for sideshooter thermal ink jet printheads that are formed of photopatternable materials that exhibit low swelling when subjected to solvent development subsequent to photoexposure and also exhibit low swelling upon exposure to solvents and aqueous media commonly used in ink jet inks. Additionally, there is a need for sideshooter thermal ink jet printheads that are formed of photopatternable materials of good lithographic sensitivity. A need also remains for sideshooter thermal ink jet printheads that are formed of thermally stable materials. In addition, a need remains for sideshooter thermal ink jet printheads that are formed of photopatternable polymers that, when applied to printhead elements by spin casting techniques and cured, exhibit reduced edge bead and no apparent lips and dips. Further, a need remains for sideshooter thermal ink jet printheads that are formed of photopatternable polymers that can be exposed without the need for mask biasing. Additionally, a need remains for thermal ink jet printheads of sideshooter configuration that enable high nozzle density, including densities of 1,200 dots per inch or more. There is also a need for sideshooter thermal ink jet printheads that are formed of photopatternable polymers that exhibit clean, sharp, square edges of the patterned features. In addition, there is a need for sideshooter thermal ink jet printheads that are formed of photopatternable materials that enable reduced or no need for polishing subsequent to patterning. Further, there is a need for sideshooter thermal ink jet printheads that are formed of photopatternable materials wherein the mask through which the photopatternable materials are exposed can be reproduced while retaining uniform film thickness across the wafer and features. Additionally, there is a need for sideshooter thermal ink jet printheads that are formed of photopatternable materials that enable a wide variety of drop volumes. A need also remains for sideshooter thermal ink jet printheads that are formed of photopatternable materials that enable a variety of cleanly defined nozzles of different dimensions and that produce different drop volumes in the same printhead.

SUMMARY OF THE INVENTION

The present invention is directed to a thermal ink jet printhead which comprises: (i) an upper substrate, and (ii) a lower substrate in which one surface thereof has an array of heating elements and addressing electrodes formed thereon, said lower substrate having an insulative layer deposited on the surface thereof and over the heating elements and addressing electrodes and patterned to form recesses therethrough to expose the heating elements and terminal ends of the addressing electrodes, said upper and lower substrates being bonded together to form a thermal ink jet printhead having droplet emitting nozzles defined by the upper substrate, the insulative layer on the lower substrate, and the heating elements in the lower substrate, wherein at least one of said upper substrate and said insulative layer comprises a crosslinked polymer formed by crosslinking a precursor polymer which is a phenolic novolac resin having glycidyl ether functional groups on the monomer repeat units thereof. Another embodiment of the present invention is directed to a process for forming a thermal ink jet printhead which comprises: (a) providing a lower substrate in which one surface thereof has an array of heating elements and addressing electrodes having terminal ends formed thereon; (b) depositing onto the surface of the lower substrate having the heating elements and addressing electrodes thereon a layer comprising a precursor polymer which is a phenolic novolac resin having glycidyl ether functional groups on the monomer repeat units thereof; (c) exposing the layer to actinic radiation in an imagewise pattern such that the precursor polymer in exposed areas becomes a crosslinked polymer and the precursor polymer in unexposed areas does not become crosslinked, wherein the unexposed areas correspond to areas of the lower substrate having thereon the heating elements and the terminal ends of the addressing electrodes; (d) removing the precursor polymer from the unexposed areas, thereby forming recesses in the layer, said recesses exposing the heating elements and the terminal ends of the addressing electrodes; (e) providing an upper substrate; and (f) bonding the upper substrate to the lower substrate to form a thermal ink jet printhead having droplet emitting nozzles defined by the upper substrate, the crosslinked polymer on the lower substrate, and the heating elements in the lower substrate.

DETAILED DESCRIPTION OF THE INVENTION

Figure 1:
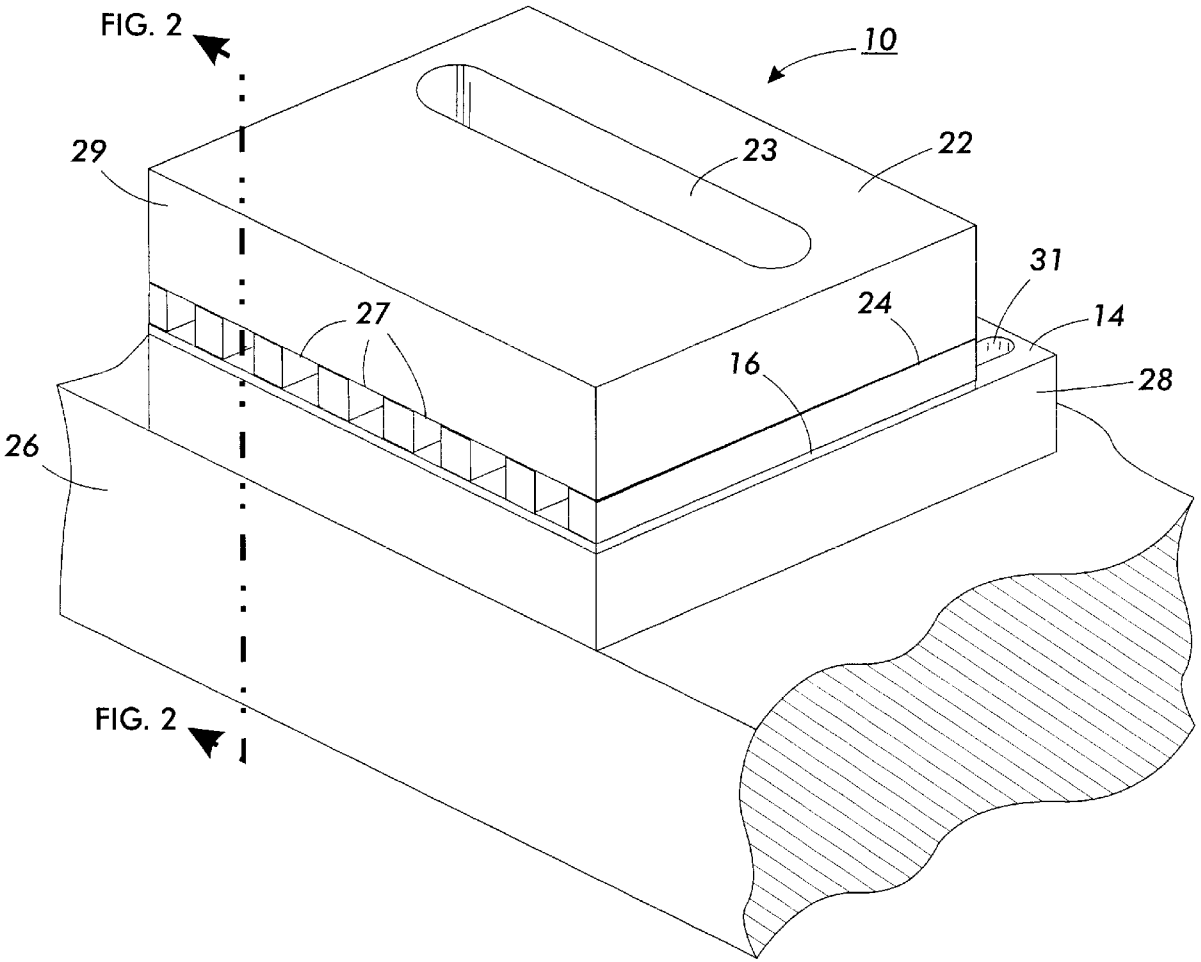
FIG. 1 is a schematic isometric view of a printhead according to the present invention and oriented so that the droplet ejecting nozzles are shown.
Figure 2:
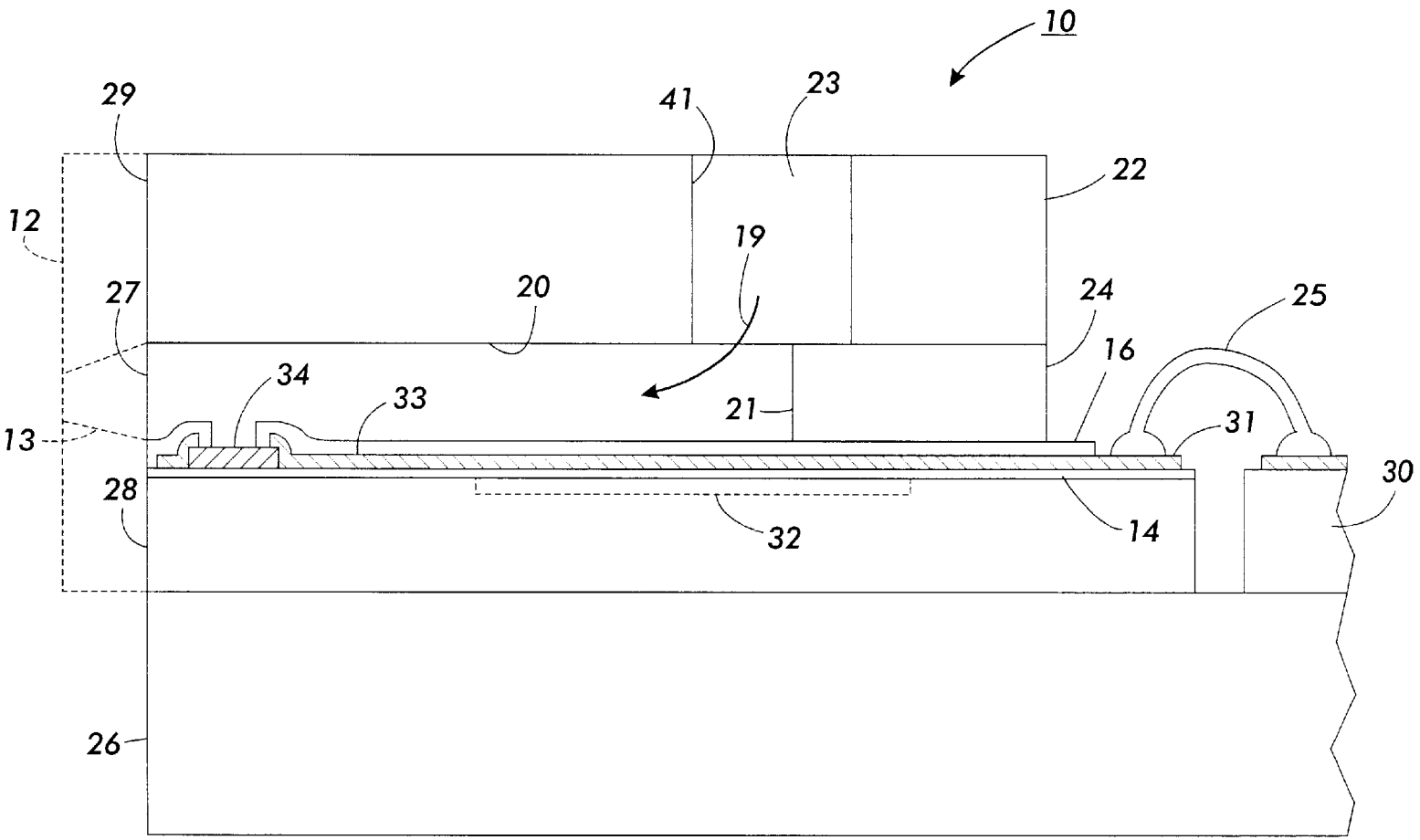
FIG. 2 is a cross-sectional view of FIG. 1 as viewed along the view line 2—2 thereof.

The thermal ink jet printheads of the present invention can be of any suitable configuration. An example of a suitable configuration is illustrated schematically in FIG. 1. In FIG. 1, a schematic isometric view of an ink jet printhead 10 according to the present invention is shown mounted on a heat sink 26 and oriented to show the front face 29 of the printhead and the array of droplet ejecting nozzles 27 therein. Referring also to FIG. 2, a cross-sectional view of FIG. 1 taken along view line 2—2 through one ink channel 20, the heater plate 28, of a material such as silicon or the like, has heating elements 34, driving circuitry 32 represented by dashed line, and leads 33 interconnecting the heating elements and driving circuitry and having contacts 31 connected to a printed circuit board 30 by wire bonds 25. The circuit board is connected to a controller or microprocessor of the printer (neither shown) for selectively applying a current pulse to the heating elements to eject ink droplets from the nozzles. One suitable driving circuitry is described in U.S. Pat. No. 4,947,192, the disclosure of which is totally incorporated herein by reference. Generally, an underglaze layer 14 is formed on the heater plate surface on which the heating elements, driving circuitry, and leads are to be formed, followed by a passivation layer 16 which is patterned to expose the heating elements and contacts.

A photosensitive polymeric material according to the present invention is deposited over the heater wafer to form the photopolymer layer 24 and photolithographically patterned to produce the ink channels 20 having an open end to serve as a nozzle 27 and a closed end 21 and to expose the contacts 31 of the electrical leads. A cover plate 22 of a material such as glass, quartz, silicon, various polymeric materials, ceramic materials, or the like, has an aperture 23 therethrough and is bonded to the surface of the patterned photopolymer layer 24 with a suitable adhesive (not shown). The cover plate aperture 23 has a size suitable to expose portions of the closed ends 21 of the channels and to provide an adequate ink supply reservoir for the printhead when combined with closed end portions 21 of the channels. The ink flow path from the reservoir to the channels 20 is indicated by arrow 19. An optional nozzle plate 12 is shown in dashed line which is adhered to the printhead front face 29 with the nozzles 13 therein aligned with the open ends 27 of the channels 20 in the photopolymer layer 24.

As disclosed in U.S. Pat. No. Re. 32,572, U.S. Pat. Nos. 4,774,530, and 4,947,192 the disclosures of each of which are totally incorporated herein by reference, the heater plates of the present invention can be batch produced on a silicon wafer (not shown) and later separated into individual heater plates 28 as one piece of the printhead 10. As disclosed in these patents, a plurality of sets of heating elements 34, driving circuitry 32, and electrical leads 33 are patterned on a polished surface of a (100) silicon wafer which has first optionally been coated with an underglaze layer 14, such as silicon dioxide having a typical thickness of about 1 to about 5 microns, although the thickness can be outside of this range. The heating elements can be of any well known resistive material, such as zirconium boride, but are preferably doped polycrystalline silicon deposited, for example, by chemical vapor deposition (CVD) and concurrently monolithically fabricated with the driving circuitry as disclosed in, for example, U.S. Pat. No. 4,947,193, the disclosure of which is totally incorporated herein by reference. Afterwards, if desired, the wafer can be cleaned and reoxidized to form a silicon dioxide layer (not shown) over the wafer, including the driving circuitry. A phosphorous doped glass layer or boron and phosphorous doped glass layer (not shown) can then, if desired, be deposited on the thermally grown silicon dioxide layer and reflowed at high temperatures to planarize the surface. The photopatternable polymer according to the present invention is applied and patterned to form vias for electrical connections with the heating elements and driving circuitry, and aluminum metallization is applied to form the electrical leads and provide the contacts for wire bonding to the printed circuit board, which in turn is connected to the printer controller. Any suitable electrically insulative passivation layer 16, such as, for example, polyimide, polyarylene ethers such as those disclosed in, for example, U.S. Pat. No. 5,994,425, the disclosure of which is totally incorporated herein by reference, polybenzoxazole, bisbenzocyclobutene (BCB), phenolic novolac resins having glycidyl ether functional groups on the monomer repeat units thereof, or the like is deposited over the electrical leads, typically to a thickness of from about 0.5 to about 20 microns, although the thickness can be outside of this range, and removed from the heating elements and contacts.

Figure 3:
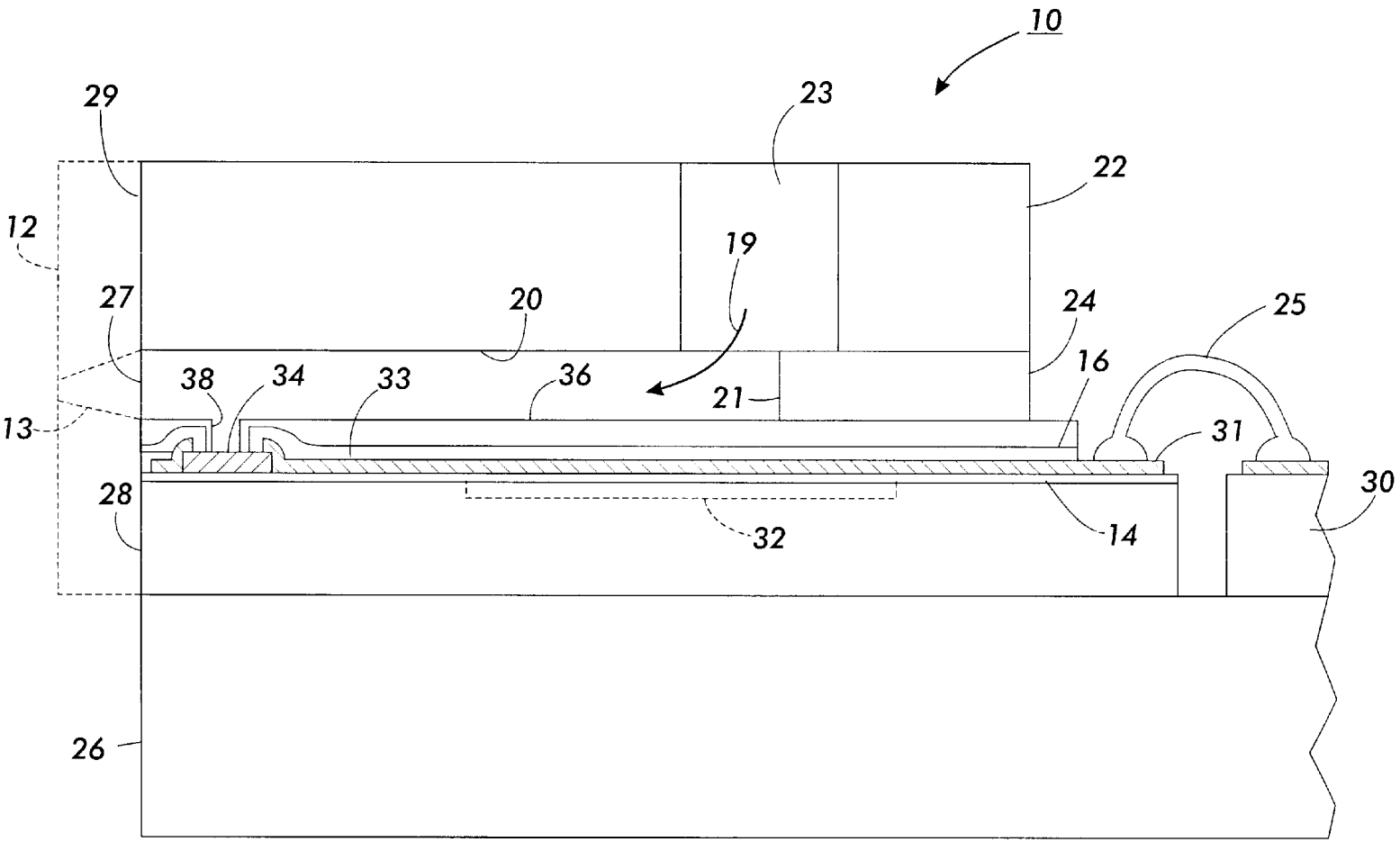
FIG. 3 is a cross-sectional view similar to FIG. 2 showing another embodiment of the present invention.

Next, an optional pit layer 36 of, for example, polyimide, polyarylene ethers such as those disclosed in, for example, U.S. Pat. No. 5,994,425, the disclosure of which is totally incorporated herein by reference, polybenzoxazole, BCB, phenolic novolac resins having glycidyl ether functional groups on the monomer repeat units thereof, or the like, can be deposited and patterned to provide pits 38 for the heating elements as shown in FIG. 3 and disclosed in U.S. Pat. No. 4,774,530, the disclosure of which is totally incorporated herein by reference. FIG. 3 is a cross-sectional view similar to that of FIG. 2, but has a pit layer 36 as taught by U.S. Pat. No. 4,774,530. The pit layer 36 can be useful for printheads having a resolution of less than 400 dpi, but can also if desired be used for higher printing resolution printheads. Except for the pit layer, the printhead and method of fabrication is same as for the printhead in FIGS. 1 and 2. The optional pit layer 36 is deposited and patterned prior to the deposition of the photopolymer layer 24. However, for high resolution printheads having nozzles spaced for printing at 400 dots per inch (dpi) or more, heating element pits may not be necessary, since the vapor bubbles generated to eject ink droplets from nozzles and channels of this size tend not to ingest air.

If the topography of the heater wafer is uneven, the wafer can be polished by techniques well known in the industry, such as that disclosed in U.S. Pat. No. 5,665,249, the disclosure of which is totally incorporated herein by reference. Then the layer of photopatternable polymer (phenolic novolac resins having glycidyl ether functional groups on the monomer repeat units thereof) that is to provide the channel structure 24 is deposited. After deposition of the photopatternable polymer layer according to the present invention, it is exposed using a mask with the channel sets pattern and contacts pattern. The patterned polymer channel structure layer is then developed and cured. In one embodiment, the channel structure thickness is typically at least about 1 micron, preferably at least about 5 microns, and more preferably at least about 10 microns, and is typically no more than about 40 microns, preferably no more than about 30 microns, and more preferably no more than about 20 microns, although the thickness can be outside of these ranges. If desired, a thicker layer can be applied and cured and then polished to the desired thickness by the same technique used to polish the surface of the heater wafer mentioned above. After the patterned photopolymer layer 24 is cured and polished, a cover plate 22, the same size as the wafer and having a plurality of apertures 23 therein, is bonded to the photopolymer layer 24. The cover plate 22 serves as the closure for the channels 20 and the cover plate aperture 23, which is an opening through the cover plate, serves as an ink inlet to the reservoir as well as most of the ink reservoir. The silicon wafer and wafer size cover plate with the channel structure sandwiched therebetween can be separated into a plurality of individual printheads by a dicing operation. The dicing operation not only separates the printheads, but also produces the printhead front face 29 and opens one end of the channels to form the nozzles 27.

Figure 4:
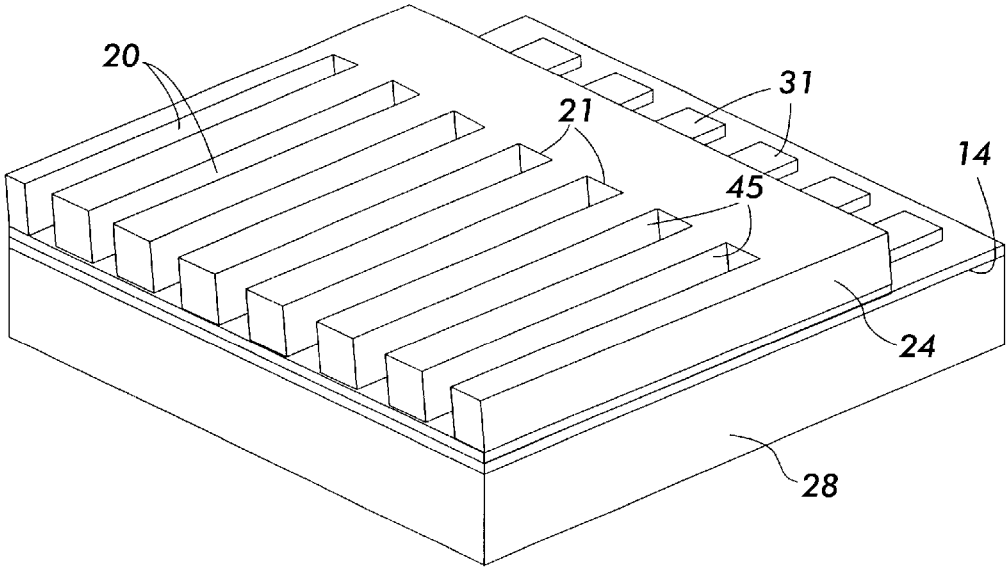
FIG. 4 is a schematic isometric view of the printhead of FIG. 1 without the cover plate.

Referring to FIG. 4, a schematic isometric view of a portion of the heater wafer is shown comprising a single heater plate 28 having the patterned, cured, and polished photopolymer channel structure 24 thereon. The cover plate is omitted. The closed end portions of the channels and the cover plate aperture define the ink reservoir.

Figure 5:
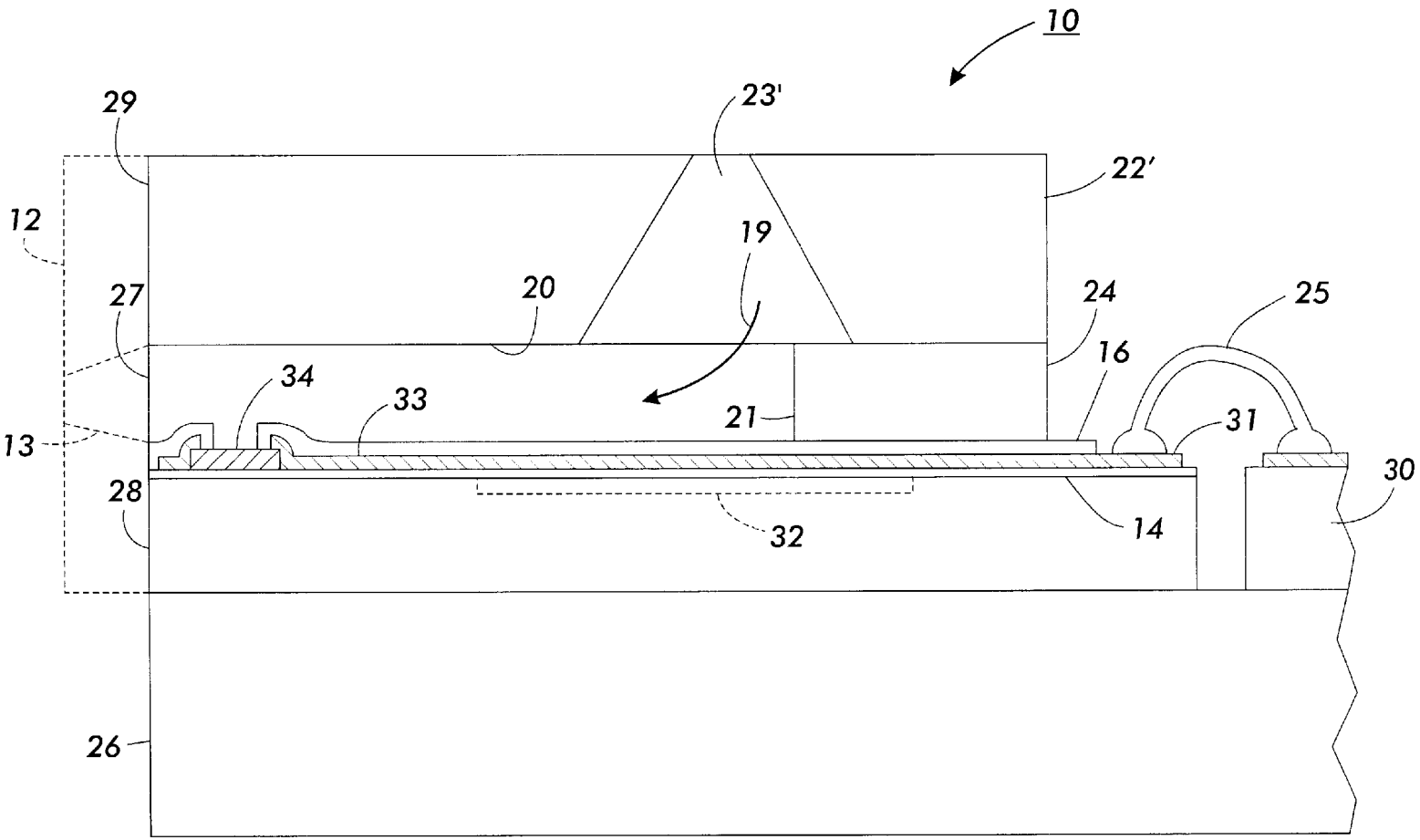
FIG. 5 is a view similar to FIG. 2 showing an alternate embodiment of the printhead cover plate.

FIG. 5 is a view similar to FIG. 2, but showing an alternate embodiment of the cover plate. In this embodiment, a silicon substrate is utilized for the cover plate 22' and has an aperture 23' formed by orientation dependent etching (ODE). The etching is done from the silicon cover plate surface which is to be bonded against the channel structure 24, thereby providing a different cross-sectional shape for the reservoir.

Figure 6:
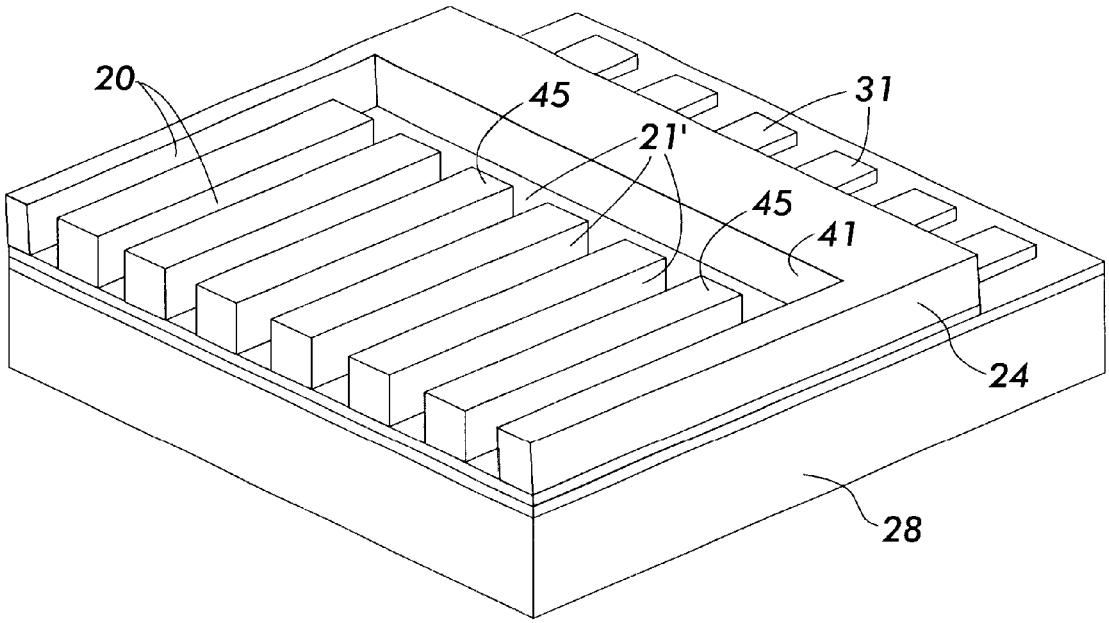
FIG. 6 is a view similar to FIG. 4 showing an alternate embodiment wherein the channel grooves open into a common recess with the walls of the channel grooves extending into the printhead reservoir.

Referring to FIG. 6, another embodiment is shown of the channel structure 24 in a view similar to that of FIG. 4. In this embodiment, the channel ends 21' connect and open into a common recess 41. Walls 45 of the channels 20 extend into the reservoir formed by combination of the cover plate aperture 23, common recess 42, and end portions of the channels ends 21'.

Figure 7:
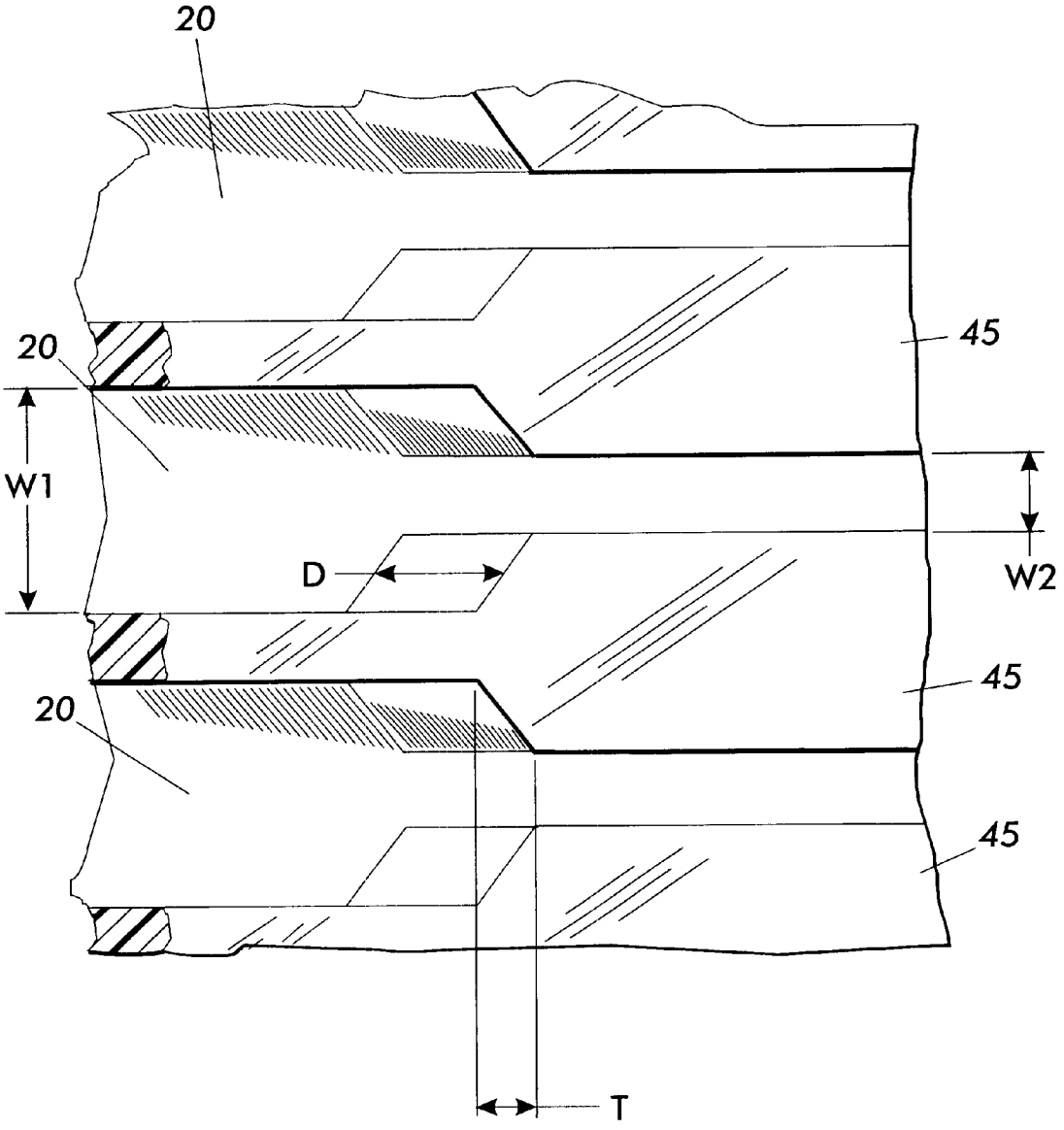
FIG. 7 is a view similar to FIG. 4 showing an alternate embodiment wherein the channel grooves are of a different geometry.

Though the channels in FIGS. 1 through 6 have been shown with a uniform square or rectangular cross-sectional ink flow area, other embodiments are also possible. For example, the parallel walls of the channels 20 can vary in distance therebetween to form, for example, channels having a uniformly narrowing ink channel which tapers from the interface with the ink reservoir to the nozzle, as shown in FIG. 4A of U.S. Pat. No. 5,132,707, the disclosure of which is totally incorporated herein by reference, varying cross-sectional flow area wherein the channel is narrow at the interface with the ink reservoir, enlarged to enhance refill near the mid-distance between the reservoir and the nozzle, and narrow again at the nozzle, as shown in FIG. 4B of U.S. Pat. No. 5,132,707, channels as shown in FIG. 7, of a thickness or depth D and initially of a first uniform width W1 at the interface with the ink reservoir, then having a tapered area T, ending in narrower channels of a second uniform width W2 that continue to the nozzles. Any other desired sideshooter channel or nozzle configuration can also be employed.

In addition, any other desired sideshooter printhead configuration can be employed. For example, upper substrate or cover plate 22 can also, if desired, have channels etched therein, of any desired shape, such as triangular, rectangular, square, or the like, wherein the upper substrate or cover plate is then aligned and mated with the lower substrate or heater plate having the resistive heater elements and channels defined in layer 24 thereon, so that the channels in upper substrate or cover plate 22 are aligned with the channels defined in layer 24 to form the ink channels or nozzles, as disclosed in, for example, U.S. Pat. Nos. 4,774,530, 6,020,119, 4,829,324, and Copending Application U.S. Ser. No. 09/120,746, the disclosures of each of which are totally incorporated herein by reference.

In one embodiment, a heater wafer with a phosphosilicate glass layer is optionally first spin coated with a solution of Z6040 adhesion promoter (about 0.5 to about 5 weight percent in about 95 parts methanol and about 5 parts water at a pH of from about 3.5 to about 5.5, available from Dow Corning) at from about 3,000 to about 5,000 revolutions per minute for about 10 seconds, and dried at from about 100 to about 110° C. for from about 2 to about 10 minutes. The wafer is then allowed to cool at about 25° C. for about 5 minutes before spin coating the photoresist containing the epoxy polymer onto the wafer at between 1,000 and 3,000 revolutions per minute for between 30 and 60 seconds. The photoresist solution is made by addition of about 63 parts by weight of an epoxy polymer of the formula

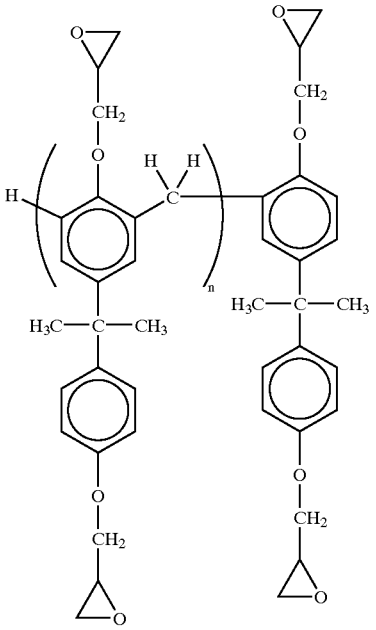

wherein n has an average value of 3 to about 20 parts by weight of γ-butyrolactone containing about 13 or 14 parts by weight triphenylsulfonium hexafluoroantimonate solution (supplied commercially as CYRACURE® UVl-6976 (obtained from Union Carbide) in a solution of 50 weight percent mixed triarylsulfonium hexafluoroantimonate in propylene carbonate). The film is heated (soft baked) in an oven for between 15 and 25 minutes at 70° C. After cooling to 25° C. over 5 minutes, the film is covered with a mask and exposed to the full arc of a super-high pressure mercury bulb, amounting to from about 25 to about 500 milliJoules per square centimeter as measured at 365 nanometers. The exposed wafer is then heated at from about 70 to about 95° C. for from about 10 to about 20 minutes post-exposure bake, followed by cooling to 25° C. over 5 minutes. The film is developed with γ-butyrolactone, washed with isopropanol, and then dried at about 70° C. for about 2 minutes. This process is intended to be a guide in that procedures can be outside the specified conditions depending on film thickness and photoresist molecular weight.

The printhead illustrated in FIGS. 1 through 7 constitutes a specific embodiment of the present invention. Any other suitable sideshooter printhead configuration comprising ink-bearing channels terminating in nozzles on the printhead surface can also be employed with the materials disclosed herein to form a printhead of the present invention. The printheads of the present invention are of "sideshooter" configuration, as opposed to "roofshooter" configuration. Roofshooter configuration printheads are illustrated in, for example, U.S. Pat. Nos. 5,859,655 and 5,907,333, the disclosures of each of which are totally incorporated herein by reference. In a typical roofshooter-type thermal ink jet printhead, a heater plate is mounted on heat sinking substrate. The silicon heater plate can have a reservoir or feed slot etched therethrough. An array of heating elements are patterned on the heater plate surface near the open bottom of the reservoir. The heating elements are selectively addressed via passivated addressing electrodes and a common return. A flow directing layer is patterned to form flow paths for the ink from the reservoir to a location above the heating elements. A nozzle plate containing nozzles is aligned and bonded to the flow directing layer so that the nozzles are directly above the heating elements. An electrical signal applied to the heating element temporarily vaporizes the ink and forms droplet ejecting bubbles which eject droplets in a direction normal or perpendicular to the plane of the heating element surface. Accordingly, the nozzles in a roofshooter printhead are defined by the nozzles in the nozzle plate and their positioning with respect to the heating elements. In contrast, the nozzles in a sideshooter printhead are defined by the bonding of the cover plate and heater wafer (although an optional nozzle plate can also be bonded to the front face of the printhead if desired). In addition, in a sideshooter printhead, an electrical signal applied to the heating element temporarily vaporizes the ink and forms droplet ejecting bubbles which eject droplets in a direction parallel to the plane of the heating element surface.

The sideshooter printheads of the present invention exhibit several advantages. For example, channels and nozzles can be patterned with aspect ratios of at least about 1:1 or more, and aspect ratios of about 6:1 or more and even about 10:1 or more are possible. Drop volumes as small as 1, 2, or 3 picoliters can be generated with ink jet printheads according to the present invention, as well as those that generate droplets of about 5 picoliters, those that generate droplets of about 10 picoliters, those that generate droplets of about 20 picoliters, those that generate droplets of about 35 picoliters, those that generate droplets of about 50 picoliters, and those that generate varying droplet volumes within and outside of these ranges. Desirable droplet volumes for black images typically are at least about 10 picoliters, and are typically no more than about 35 picoliters, preferably no more than about 20 picoliters, although the droplet volume for black images can be outside of these values. Desirable droplet volumes for color images typically are at least about 1 picoliter, and preferably at least about 3 picoliters, and are typically no more than about 25 picoliters, preferably no more than about 10 picoliters, and more preferably no more than about 5 picoliters, although the droplet volume for color images can be outside of these values. Single printheads with nozzles generating different droplet sizes, and single wafers imaged with different printheads each capable of generating different droplet sizes, can be prepared according to the present invention. A single printhead, or a single wafer patterned with multiple printheads, can be patterned with nozzles generating about 1 picoliter drops, nozzles generating about 2 picoliter drops, nozzles generating about 3 picoliter drops, nozzles generating about 5 picoliter drops, nozzles generating about 10 picoliter drops, nozzles generating about 20 picoliter drops, nozzles generating about 35 picoliter drops, nozzles generating about 50 picoliter drops, and nozzles capable of generating drops anywhere within the range of from about 1 to about 50 picoliters. While drop volume depends also on variables such as heater design and channel structure, nozzles such as those about 10 microns wide by about 10 microns deep can generate droplet volumes of from about 1 to about 5 picoliters. (In the context of the present invention with respect to ink channels or nozzles, the terms "wide" and "width" refer to widths such as W1 or W2 in FIG. 7, and the terms "deep" and "depth" refer to depths such as "D" in FIG. 7.) Preferred nozzles have a width of at least about 5 microns, and preferably at least about 8 microns, and of no more than about 25 microns, and preferably no more than about 15 microns, although the width can be outside of these ranges. Preferred nozzles have a depth of at least about 5 microns, and preferably at least about 8 microns, and of no more than about 25 microns, and preferably no more than about 15 microns, although the depth can be outside of these ranges. Printheads capable of generating resolutions of about 300 dpi, about 400 dpi, about 600 dpi, about 900 dpi, about 1,200 dpi, or more can be prepared according to the present invention. Nozzles can be prepared with clean, sharp, square edges and with minimal or no need to polish the structure containing the nozzles subsequent to patterning. The photoimaging mask can be reproduced while retaining substantially uniform film thickness across the wafer and patterned features, and minimal or no mask biasing are necessary. High nozzle density sideshooter printheads can be prepared. This advantage is particularly important to the sideshooter configuration. Roofshooter configuration printheads, as illustrated by, for example, roofshooter-type printhead subunits 26 in FIG. 8 of U.S. Pat. No. 5,160,945, the disclosure of which is totally incorporated herein by reference, enable high nozzle density by staggering the openings of the nozzle plate. In the sideshooter configuration of the present invention, in contrast, as shown in FIG. 1 of the present application, high nozzle density is obtained with nozzles in a linear array.

Further details regarding methods of fabricating printheads are disclosed in, for example, U.S. Pat. Nos. 4,678,529, 5,057,853, 4,774,530, 4,835,553, 4,638,337, 5,336,319, and 4,601,777, the disclosures of each of which are totally incorporated herein by reference. Additional examples of suitable sideshooter configurations are disclosed in, for example, U.S. Pat. Nos. 5,132,707, 5,994,425, Copending Application U.S. Ser. No. 09/210,137, Copending Application U.S. Ser. No. 09/046,852, Copending Application U.S. Ser. No. 09/325,837, Copending Application U.S. Ser. No. 09/120,746, Copending Application U.S. Ser. No. 09/356,661, Copending Application U.S. Ser. No. 09/217,330, and Copending Application U.S. Ser. No. 09/152,100, the disclosures of each of which are totally incorporated herein by reference.

At least one of insulative layer 24 and cover plate or upper substrate 22 are formed by crosslinking a precursor polymer which is a phenolic novolac resin having glycidyl ether functional groups on the monomer repeat units thereof. The glycidyl ether functional groups generally are situated at the locations of the former hydrogen atoms on the phenolic hydroxy groups. Examples of suitable backbone monomers for the phenolic novolac resin include phenol, of the formula

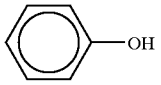

wherein the resulting glycidyl ether functionalized novolac resin includes structures of the formulae

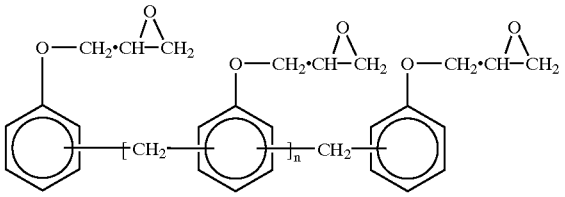

as well as branched structures thereof, o-cresol and p-cresol, of the formulae

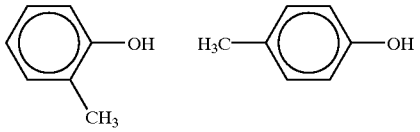

wherein the resulting glycidyl ether functionalized novolac resin includes structures of the formulae

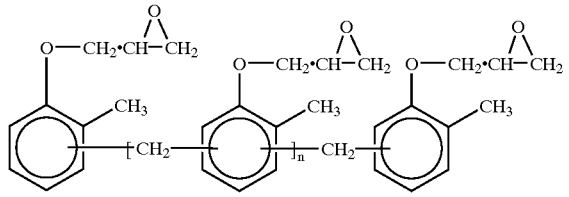

and

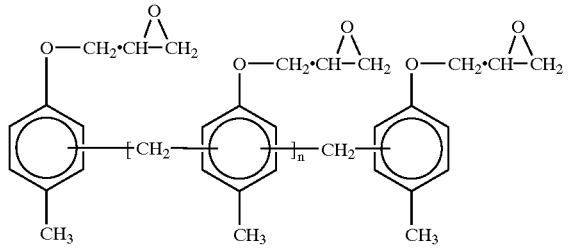

as well as branched structures thereof, bisphenol-A, of the formula

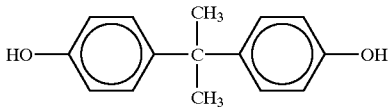

wherein the resulting glycidyl ether functionalized novolac resin includes structures of the formulae

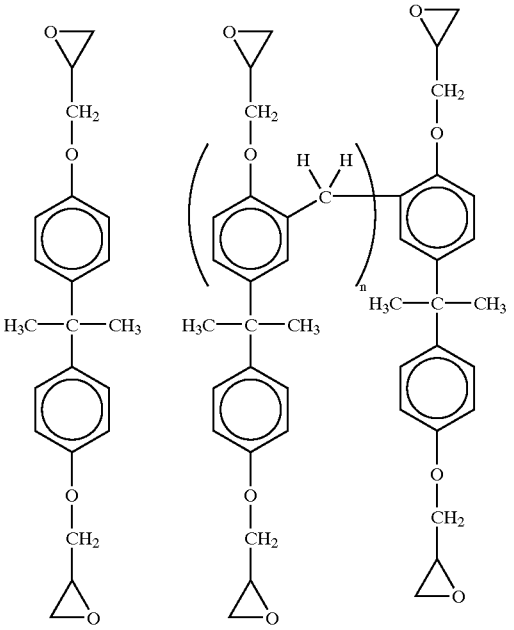

-continued

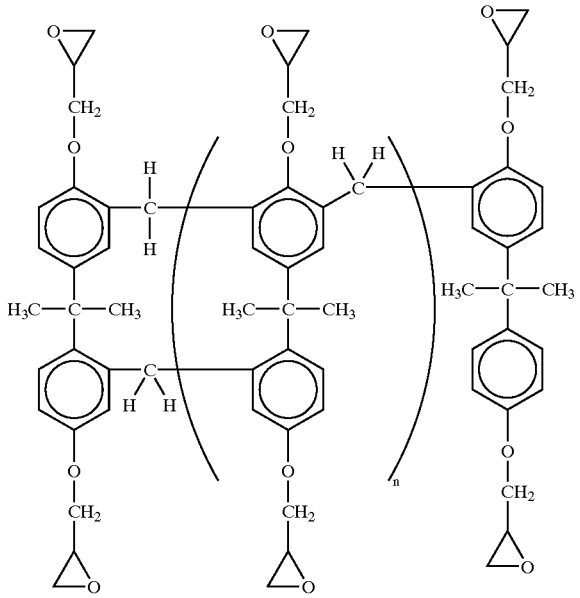

as well as randomized and branched structures thereof, and the like. The average number of repeat monomer units typically is from about 1 to about 20, and preferably is about 2, although the value of n can be outside of this range. One particularly preferred polymer is of the formula

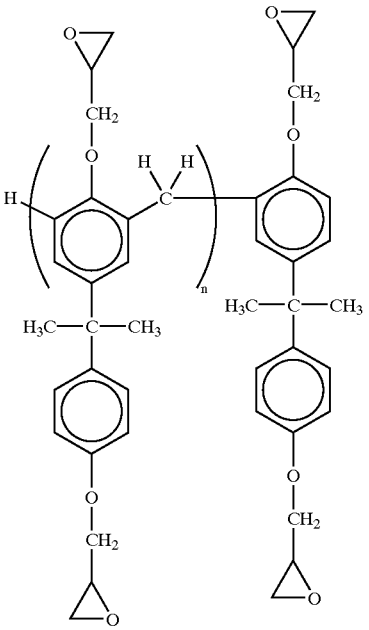

wherein n is an integer representing the average number of repeating monomer units and typically is from about 2 to about 20, and preferably is about 3 although the value of n can be outside of this range. Another particularly preferred polymer is of the formula

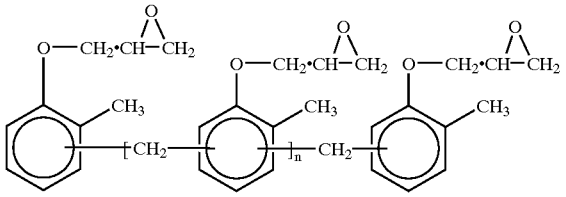

wherein n is an integer representing the average number of repeating monomer units and typically is from about 1 to about 20, and preferably is about 2, although the value of n can be outside of this range. Polymers of the formula

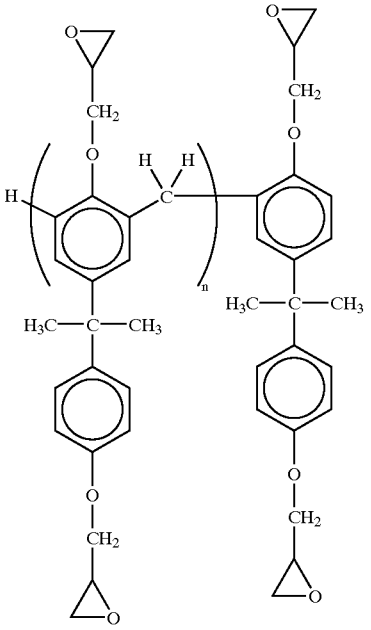

wherein n has an average value of about 3 are commercially available from, for example, Shell Resins, Shell Oil Co., Houston, Tex. as EPON® SU-8. Commercial photoresists containing this polymer, a solvent, and a cationic initiator are also available from MicroChem Corporation, Newton, Mass. and from Sotec Microsystems, Switzerland. This type of photoresist is also disclosed in, for example, U.S. Pat. No. 4,882,245, the disclosure of which is totally incorporated herein by reference. Polymers of the formula

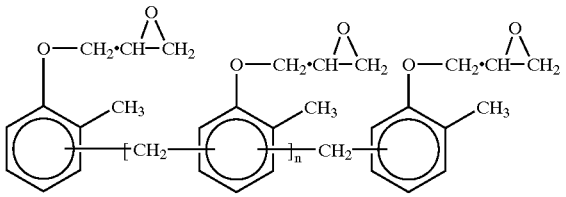

wherein n has an average value of about 3 are commercially available from, for example, Shell Resins, Shell Oil Co., Houston, Tex. as EPON® DPS-164. Suitable photoresists of the general formulae set forth hereinabove are also available from, for example, Dow Chemical Co., Midland, Mich.

The portion of the printhead containing the crosslinked epoxy polymer is prepared by applying to the printhead a photoresist containing the uncrosslinked precursor epoxy polymer, an optional solvent for the precursor polymer, a cationic photoinitiator, and an optional sensitizer. The solvent and precursor polymer typically are present in relative amounts of from 0 to about 99 percent by weight solvent and from about 1 to 100 percent precursor polymer, preferably are present in relative amounts of from about 5 to about 60 percent by weight solvent and from about 40 to about 95 percent by weight polymer, and more preferably are present in relative amounts of from about 5 to about 40 percent by weight solvent and from about 60 to about 95 percent by weight polymer, although the relative amounts can be outside these ranges. Examples of suitable solvents include γ-butyrolactone, propylene glycol methyl ether acetate, tetrahydrofuran, methyl ethyl ketone, methyl isobutyl ketone, mixtures thereof, and the like.

Sensitizers absorb light energy and facilitate the transfer of energy to another compound, which can then form radical or ionic initiators to react to crosslink the precursor polymer. Sensitizers frequently expand the useful energy wavelength range for photoexposure, and typically are aromatic light absorbing chromophores. Sensitizers can also lead to the formation of photoinitiators, which can be free radical or ionic. When present, the optional sensitizer and the precursor polymer typically are present in relative amounts of from about 0.1 to about 20 percent by weight sensitizer and from about 80 to about 99.9 percent by weight precursor polymer, and preferably are present in relative amounts of from about 1 to about 20 percent by weight sensitizer and from about 80 to about 99 percent by weight precursor polymer, although the relative amounts can be outside these ranges.

Photoinitiators generally generate ions or free radicals which initiate polymerization upon exposure to actinic radiation. When present, the optional photoinitiator and the precursor polymer typically are present in relative amounts of from about 0.1 to about 20 percent by weight photoinitiator (in its pure form; not accounting for any solvent in which it may be commercially supplied) and from about 80 to about 99.9 percent by weight precursor polymer, and preferably are present in relative amounts of from about 1 to about 20 percent by weight photoinitiator and from about 80 to about 99 percent by weight precursor polymer, although the relative amounts can be outside these ranges.

A single material can also function as both a sensitizer and a photoinitiator.

Further background material on initiators is disclosed in, for example, Ober et al., *J.M.S.—Pure Appl. Chem.,* A30 (12), 877–897 (1993); G. E. Green, B. P. Stark, and S. A. Zahir, "Photocrosslinkable Resin Systems," *J. Macro. Sci.—Revs. Macro. Chem.,* C21(2), 187 (1981); H. F. Gruber, "Photoinitiators for Free Radical Polymerization," *Prog. Polym. Sci., Vol.* 17, 953 (1992); Johann G. Kloosterboer, "Network Formation by Chain Crosslinking Photopolymerization and Its Applications in Electronics," *Advances in Polymer Science,* 89, Springer-Verlag Berlin Heidelberg (1988); and "Diaryliodonium Salts as Thermal Initiators of Cationic Polymerization," J. V. Crivello, T. P. Lockhart, and J. L. Lee, *J. of Polymer Science: Polymer Chemistry Edition,* 21, 97 (1983), the disclosures of each of which are totally incorporated herein by reference. Sensitizers are available from, for example, Aldrich Chemical Co., Milwaukee, Wis., First Chemical Corporation, Pascagoula, Miss., and Pfaltz and Bauer, Waterberry, Conn. Aromatic ketones, including benzophenone and its derivatives, thioxanthone, camphor quinone, and the like can function as photosensitizers. Additional examples of suitable photoinitiators include onium salts of Group VA elements, onium salts of Group VIA elements, such as sulfonium salts, and aromatic halonium salts, such as aromatic iodonium salts. Specific examples of sulfonium salts include triphenylsulfonium tetrafluoroborate, methyldiphenylsulfonium tetrafluoroborate, dimethylphenylsulfonium hexafluorophosphate, triphenylsulfonium hexafluorophosphate, triphenylsulfonium hexafluoroantimonate, diphenylnaphthylsulfonium hexafluoroarsenate, tritolysulfonium hexafluorophosphate, anisyldiphenylsulfonium hexafluoroantimonate, 4-butoxyphenyidiphenylsulfonium tetrafluoroborate, 4-chlorophenyidiphenylsulfonium hexafluoroantimonate, tris(4-phenoxyphenyl)sulfonium hexafluorophosphate, di(4-ethoxyphenyl)methylsulfonium hexafluoroarsenate, 4-acetoxy-phenyldiphenylsulfonium tetrafluoroborate, tris (4-thiomethoxyphenyl)sulfonium hexafluorophosphate, di(methoxysulfonylphenyl)methylsulfonium hexafluoroantimonate, di(methoxynapththyl) methylsulfonium tetrafluoroborate, di(carbomethoxyphenyl)methylsulfonium hexafluorophosphate, 4-acetamidophenyldiphenylsulfonium tetrafluoroborate, dimethylnaphthylsulfonium hexafluorophosphate, trifluoromethyidiphenylsulfonium tetrafluoroborate, methyl(n-methylphenothiazinyl) sulfonium hexafluoroantimonate, phenylmethylbenzylsulfonium hexafluorophosphate, and the like. Specific examples of aromatic iodonium salts include diphenyliodonium tetrafluoroborate, di(4-methylphenyl)iodonium tetrafluoroborate, phenyl-4-methylphenyliodonium tetrafluoroborate, di(4-heptylphenyl)iodonium tetrafluoroborate, di(3-nitrophenyl)iodonium hexafluorophosphate, di(4-chlorophenyl)iodonium hexafluorophosphate, di(naphthyl)iodonium tetrafluoroborate, di(4-trifluoromethylphenyl)iodonium tetrafluoroborate, diphenyliodonium hexafluorophosphate, di(4-methylphenyl)iodonium hexafluorophosphate, diphenyliodonium hexafluoroarsenate, di(4-phenoxyphenyl) iodonium tetrafluoroborate, phenyl-2-thienyliodonium hexafluorophosphate, 3,5-dimethylpyrazolyl-4-phenyliodonium hexafluorophosphate, diphenyliodonium hexafluoroantimonate, 2,2'-diphenyliodonium tetrafluoroborate, di(2,4-dichlorophenyl)iodonium hexafluorophosphate, di(4-bromophenyl)iodonium hexafluorophosphate, di(4-methoxyphenyl)iodonium hexafluorophosphate, di(3-carboxyphenyl)iodonium hexafluorophosphate, di(3-methoxycarbonylphenyl) iodonium hexafluorophosphate, di(3-methoxysulfonylphenyl)iodonium hexafluorophosphate, di(4-acetamidophenyl)iodonium hexafluorophosphate, di(2-benzoethienyl)iodonium hexafluorophosphate, and the like. Triarylsulfonium and diaryl iodonium salts are examples of typical cationic photoinitiators. Aromatic onium salts of Group VIA elements, such as triarylsulfonium salts, are particularly preferred photoinitiators for the present invention, initiators of this type are disclosed in, for example, U.S. Pat. Nos. 4,058,401 and 4,245,029, the disclosures of each of which are totally incorporated herein by reference. Particularly preferred for the present invention are triphenylsulfonium hexafluoroantimonate and the like.

While the printheads of the present invention can be prepared with photoresist solutions containing only the precursor polymer, cationic initiator, and optional solvent, other optional ingredients can also be contained in the photoresist. For example, diluents can be employed if desired. Examples of suitable diluents include epoxy-substituted polyarylene ethers, such as those disclosed in U.S. Pat. No. 5,945,253, the disclosure of which is totally incorporated herein by reference, bisphenol-A epoxy materials, such as those disclosed as (nonpatternable) adhesives) in U.S. Pat. No. 5,762,812, the disclosure of which is totally incorporated herein by reference, having typical numbers of repeat monomer units of from about 1 to about 20, although the number of repeat monomer units can be outside of this range, and the like. Diluents can be present in the photoresist in any desired or effective amount, typically at least about 1 part by weight per 1 part by weight precursor polymer, and typically no more than about 70 parts by weight per one part by weight precursor polymer, preferably no more than about 10 parts by weight per one part by weight precursor polymer, and more preferably no more than about 5 parts by weight per one part by weight precursor polymer, although the relative amounts can be outside of these ranges.

The printheads of the present invention can be prepared with high aspect ratios and straight sidewalls. Channels and/or nozzles as small as 5 microns wide (corresponding to distances W1 and W2 in FIG. 7) can be easily resolved in 28 micron thick films exposed at, for example 200 to 500 milliJoules per square centimeter (typically plus or minus about 50 milliJoules per square centimeter, preferably plus or minus about 25 milliJoules per square centimeter) (aspect ratio of 5.6). Preferred exposures can vary depending on the cationic initiator employed, the presence or absence of a diluent, relative humidity, and the like. These results easily enable high jet densities, jet densities typically are at least about 300 dots per inch, preferably at least about 600 dots per inch, and more preferably at least about 1,200 dots per inch, although the jet density can be outside of these ranges. Scanning electron microscopy micrographs indicate a topographically level surface devoid of detrimental lips or dips.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Resist Solution Preparation

A resist solution was prepared by adding to a jar 33 grams of γ-butyrolactone (obtained from Aldrich Chemical Co., Milwaukee, Wis.) and 23.3 grams of CYRACURE® UVI-6976 (containing 50 percent by weight triphenylsulfonium hexafluoroantimonate in propylene carbonate, obtained from Union Carbide). Thereafter, 115 grams of EPON® SU-8 epoxy polymer of the formula

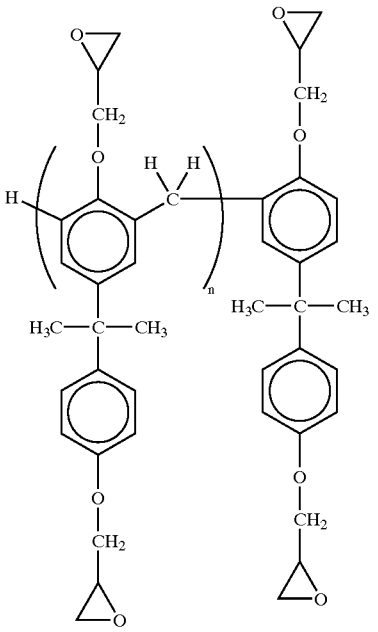

wherein n has an average value of 3 (obtained from Shell Resins) was added to the jar and the solution was mixed on a STONEWARE® roller for about one week prior to use.

A commercial resist solution of EPON SU-8 was also obtained from MicroChem Corporation, Newton, Mass., and was used as received. This commercial solution is of similar composition to the one prepared as described; more specifically, according to the MSDS sheet for this product, the commercial solution contained between 25 and 50 percent by weight γ-butyrolactone, between 1 and 5 percent by weight of a mixed triarylsulfonium hexafluoroantimonate salt (sulfonium(thiodi-4,1-phenylene)bis(diphenylbis[(OC-6-11)hexafluoroanti monate(1-)], CAS 89452-37-9, and p-thiophenoxyphenyldiphenylsulfonium hexafluoroantimonate, CAS 71449-78-0) in propylene carbonate, and between 50 and 75 percent by weight of the epoxy resin.

Substrate Preparation

Round blank silicon wafers (also referred to as monitor wafers) 4 and 5 inches in diameter, the top levels of which contained oxide or bare silicon were cleaned in a bath containing 75 percent by weight sulfuric acid and 25 percent by weight hydrogen peroxide at a temperature of 120° C. Heater wafers five inches in diameter were treated with an oxygen plasma prior to use. The wafers were heated on a hot plate at 70° C. for 2 minutes prior to application of a resist mixture. About 3 to 4 grams of resist was applied to the wafers followed by spin coating on a Headway Research Inc. PWM 101 spin coater at 2,000 to 4,000 rpm for 20 seconds. The resulting films were soft-baked in a circulating air oven at 70° C. for 20 minutes.

Photoexposure and Processing

The wafers containing the soft-baked resist films thereon were exposed through a chromium mask to the actinic radiation of an exposure aligner unit until the required dose had been delivered to the film. Exposure was effected with two different tools: (a) a CANON® PLA-501FA unit with a 250 Watt Ushio super-high pressure mercury lamp (model 250D) as the light source; (b) a KARL SUSS® MA 150 unit with a 350 Watt Ushio super high pressure mercury lamp (model 350DS) as the light source. The light intensity was about 6 to 10 milliWatts per square centimeter for each unit measured at 365 nanometers. Both exposure stations were operated on contact printing mode and the light intensity was measured at 365 nanometers. Light intensity for exposure with the CANON® PLA-501FA unit was performed using a UVP model UVX digital radiometer, the KARL SUSS® MA 150 unit had a built-in internal radiometer. All wafers were subjected to a post-exposure bake for 15 to 20 minutes at 70 to 95° C. in a circulating air oven directly after exposure. Subsequent to the post-exposure bake, the latent images were exposed to development with γ-butyrolactone (obtained from Aldrich Chemical Co.), followed by rinsing with isopropanol.

Photoresist Film Characterization

Film thickness was measured with a DEKTAK® 3030. The film thickness reported was from the non-patterned areas between print elements at the center of the wafer. Film features were recorded digitally with a computer using a SNAPPY® video capture system attached to a NIKON® TV lens c-0.45x mounted onto an OLYMPUS® STM-UM microscope.

Results

Overall, clean, well-resolved nozzles with widths between 5 and 10 microns and film thicknesses between 28 and 35 microns were resolved for plain silicon surfaces and for electrically active metal wafers. Nearly identical results were obtained with the resist solution mixed as indicated above and the commercial resist solution obtained from MicroChem Corporation.

A

Nozzle dimensions and film thickness were assessed for a 31.7 micron thick film prepared from the commercial resist solution obtained from MicroChem Corporation coated onto a 4 inch diameter bare silicon monitor wafer. The nozzle width was measured to be 7.96 microns wide, where the chromium mask measured 10.46 microns. A thermal cure cycle of exposure to 200° C. for 30 minutes in air yielded no measurable change in nozzle dimensions or film thickness. An additional cure at 300° C. for 30 minutes in air provided a nozzle width of 10.92 microns and a film thickness of 29.6 microns. The epoxy resin photoresist provided final dimensions similar to the chromium mask, potentially eliminating the need for mask biasing. (With many known photoresists, the mask openings are adjusted in size to take into account anticipated shrinkage.) The photoresist was exposed on the CANON® aligner unit for a dose of 150 milliJoules per square centimeter, light intensity of 9.20 milliWatts per square centimeter, followed by a post-exposure bake of 15 minutes at 95° C. The image was resolved through a 40 second development cycle with γ-butyrolactone (obtained from Aldrich Chemical Co.) and a rinse of isopropanol.

B

As observed with an optical micrograph, completely open 10 micron nozzles in a film thickness of 35.0 microns were obtained with the resist solution prepared as described above coated onto a 4 inch diameter bare silicon monitor wafer. The wafer was exposed through the chromium mask measuring 10.46 microns on the CANON® aligner unit for a dose of 500 milliJoules per square centimeter, light intensity of 9.20 milliWatts per square centimeter, followed by a post-exposure bake of 20 minutes at 70° C. The image was resolved through a 40 second development cycle with γ-butyrolactone (obtained from Aldrich Chemical Co.) and a rinse of isopropanol. A scanning electron micrograph indicated that the resist layer was topographically smooth and continuous with little evidence of rounding after development. A close-up view of the nozzles indicated that lips and dips were visually absent. The sidewall profile was very straight and indicated that little or no swelling occurred during development. Undercutting was also not observed.

C

Nozzle dimensions and film thickness were assessed for a 28 micron thick film prepared from the commercial resist solution obtained from MicroChem Corporation coated onto a 5 inch diameter silicon heater wafer. The wafer was exposed on the KARL SUSS® aligner unit for a dose of 300 milliJoules per square centimeter, light intensity of 6.00 milliWatts per square centimeter, followed by a post-exposure bake of 15 minutes at 95° C. The image was resolved through a 40 second development cycle with γ-butyrolactone (obtained from Aldrich Chemical Co.) and a rinse of isopropanol, An optical micrograph of the developed wafer indicated 6 micron nozzles and a film thickness of 28 microns. No obvious change in the wall profile was observed for regions of varying reflectivity of the heater wafer.

D

Nozzle dimensions and film thickness were assessed for a 28 micron thick film prepared from the commercial resist solution obtained from MicroChem Corporation coated onto a 5 inch diameter silicon heater wafer. The wafer was exposed on the KARL SUSS® aligner unit for a dose of 300 milliJoules per square centimeter, light intensity of 6.00 milliWatts per square centimeter, followed by a post-exposure bake of 15 minutes at 95° C. The image was resolved through a 50 second development cycle with γ-butyrolactone (obtained from Aldrich Chemical Co.) and a rinse of isopropanol. An optical micrograph of the developed wafer indicated 5 micron nozzles and a film thickness of 28 microns, illustrating the successful patterning of 1200 dot per inch patterns.

Other embodiments and modifications of the present invention may occur to those of ordinary skill in the art subsequent to a review of the information presented herein; these embodiments and modifications, as well as equivalents thereof, are also included within the scope of this invention.

What is claimed is:

1. A thermal ink jet printhead which comprises: (i) an upper substrate, and (ii) a lower substrate in which one surface thereof has an array of heating elements and addressing electrodes formed thereon, said lower substrate having an insulative layer deposited on the surface thereof and over the heating elements and addressing electrodes and patterned to form recesses therethrough to expose the heating elements and terminal ends of the addressing electrodes so as to form a plurality of ink channels, said upper and lower substrates being bonded together to form a thermal ink jet printhead having droplet emitting nozzles defined by the upper substrate, the insulative layer on the lower substrate, and the heating elements in the lower substrate, wherein at least one of said upper substrate and said insulative layer comprises a crosslinked polymer formed by crosslinking a precursor polymer which is a phenolic novolac resin having glycidyl ether functional groups on the monomer repeat units thereof.

2. A printhead according to claim 1 wherein the insulative layer comprises the crosslinked polymer.

3. A printhead according to claim 1 wherein the crosslinked polymer is crosslinked by exposing the precursor polymer to actinic radiation.

4. A printhead according to claim 1 wherein the precursor polymer is formed of backbone monomers selected from the group consisting of phenol, o-cresol, p-cresol, bisphenol-A, and mixtures thereof.

5. A printhead according to claim 1 wherein the precursor polymer is selected from the group consisting of

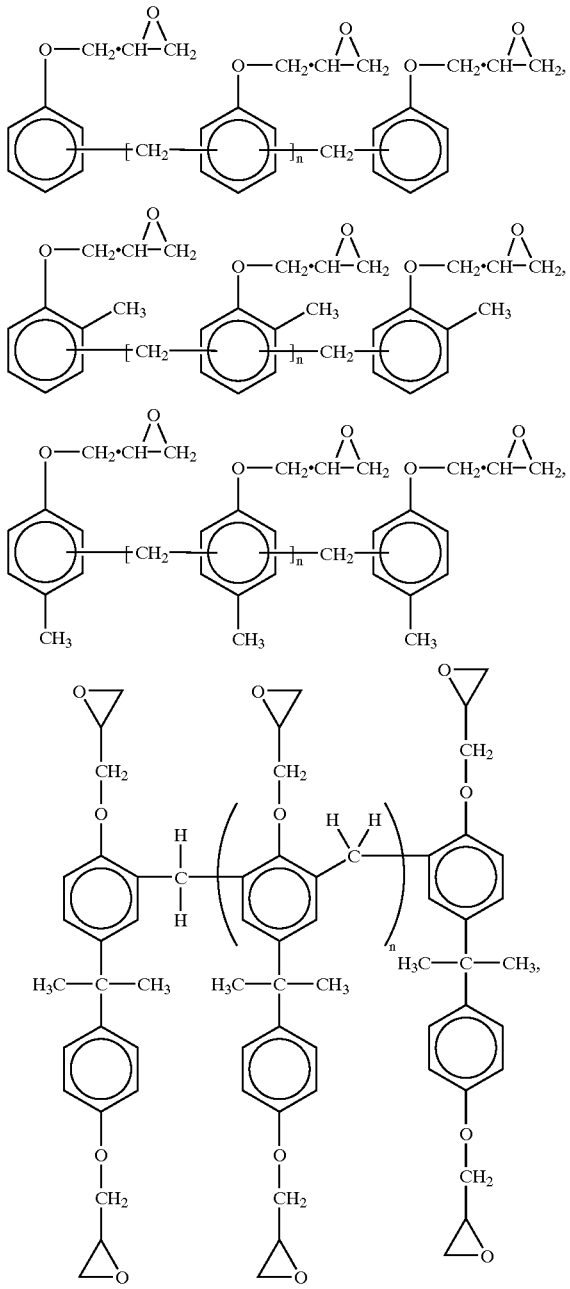

-continued

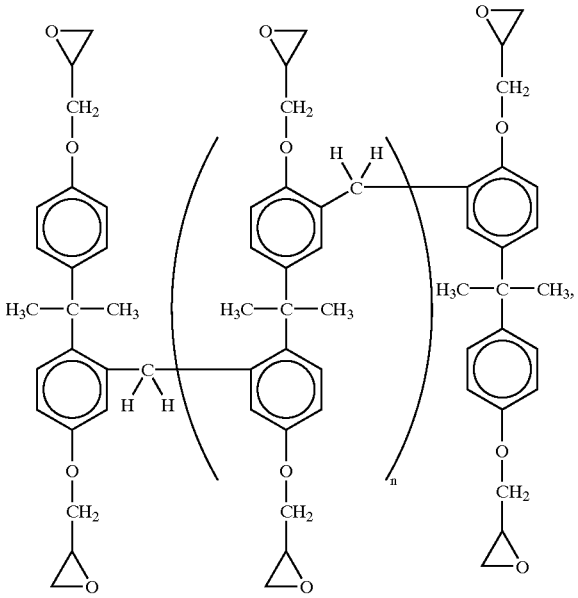

randomized structures thereof, and branched structures thereof, wherein in each instance n represents the average number of repeat monomer units.

6. A printhead according to claim 1 wherein the precursor polymer is

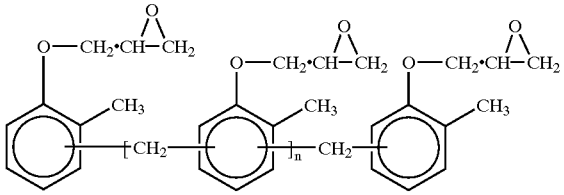

wherein n is an integer representing the average number of repeating monomer units.

7. A printhead according to claim 6 wherein n is from about 1 to about 20.

8. A printhead according to claim 6 wherein n is about 2.

9. A printhead according to claim 1 wherein the precursor polymer is crosslinked by exposing to actinic radiation a composition consisting essentially of the precursor polymer, a cationic photoinitiator, and an optional solvent.

10. A printhead according to claim 1 wherein the precursor polymer is crosslinked by exposing to actinic radiation a composition consisting of the precursor polymer, a cationic photoinitiator, and an optional solvent.

11. A printhead according to claim 1 wherein the precursor polymer is crosslinked by exposing to actinic radiation a composition comprising the precursor polymer and a diluent.

12. A printhead according to claim 11 wherein the diluent is an epoxy-substituted polyarylene ether, a bisphenol-A epoxy material, or a mixture thereof.

13. A printhead according to claim 1 wherein the nozzles eject droplets with volumes of no more than about 5 picoliters.

14. A printhead according to claim 1 wherein the nozzles eject droplets with volumes of no less than about 20 picoliters.

15. A printhead according to claim 1 wherein the insulative layer has a thickness of up to about 40 microns.

16. A printhead according to claim 15 wherein the recesses patterned through the insulative layer have an aspect ratio of at least about 1:1.

17. A printhead according to claim 15 wherein the recesses patterned through the insulative layer have an aspect ratio of at least about 5:1.

18. A printhead according to claim 15 wherein the recesses patterned through the insulative layer have an aspect ratio of at least about 6:1.

19. A printhead according to claim 15 wherein the recesses patterned through the insulative layer have an aspect ratio of at least about 10:1.

20. A printhead according to claim 1 wherein the nozzles have a width of at least about 5 microns, a width of no more than about 25 microns, a depth of at least about 5 microns, and a depth of no more than about 25 microns.

21. A thermal ink jet printhead which comprises: (i) an upper substrate, and (ii) a lower substrate in which one surface thereof has an array of heating elements and addressing electrodes formed thereon, said lower substrate having an insulative layer deposited on the surface thereof and over the heating elements and addressing electrodes and patterned to form recesses therethrough to expose the heating elements and terminal ends of the addressing electrodes so as to form a plurality of ink channels, said upper and lower substrates being bonded together to form a thermal ink jet printhead having droplet emitting nozzles defined by the upper substrate, the insulative layer on the lower substrate, and the heating elements in the lower substrate, wherein at least one of said upper substrate and said insulative layer comprises a crosslinked polymer formed by crosslinking a precursor polymer which is a phenolic novoloc resin having glycidyl ether functional groups on the monomer repeat units thereof, wherein the upper substrate comprises the crosslinked polymer.

22. A printhead according to claim 21 wherein both the insulative layer and the upper substrate comprise the crosslinked polymer.

23. A thermal ink jet printhead which comprises: (i) an upper substrate, and (ii) a lower substrate in which one surface thereof has an array of heating elements and addressing electrodes formed thereon, said lower substrate having an insulative layer deposited on the surface thereof and over the heating elements and addressing electrodes and patterned to form recesses therethrough to expose the heating elements and terminal ends of the addressing electrodes so as to form a plurality of ink channels, said upper and lower substrates being bonded together to form a thermal ink jet printhead having droplet emitting nozzles defined by the upper substrate, the insulative layer on the lower substrate, and the heating elements in the lower substrate, wherein at least one of said upper substrate and said insulative layer comprises a crosslinked polymer formed by crosslinking a precursor polymer which is a phenolic novolac resin having glycidyl ether functional groups on the monomer repeat units thereof, wherein the precursor polymer is

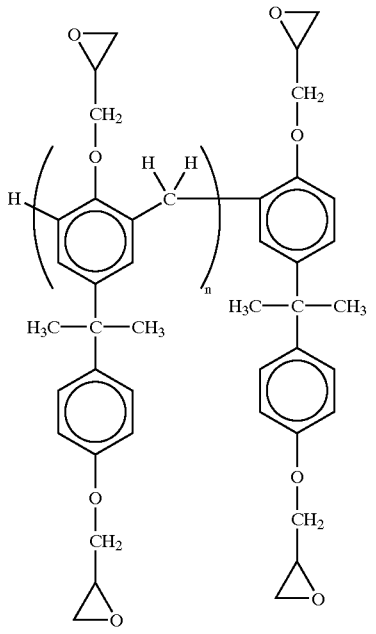

wherein n is an integer representing the average number of repeating monomer units.

24. A printhead according to claim 23 wherein n is from about 2 to about 20.

25. A printhead according to claim 23 wherein n is about 3.

26. A thermal ink jet printhead which comprises: (i) an upper substrate, and (ii) a lower substrate in which one surface thereof has an array of heating elements and addressing electrodes formed thereon, said lower substrate having an insulative layer deposited on the surface thereof and over the heating elements and addressing electrodes and patterned to form recesses therethrough to expose the heating elements and terminal ends of the addressing electrodes so as to form a plurality of ink channels, said upper and lower substrates being bonded together to form a thermal ink jet printhead having droplet emitting nozzles defined by the upper substrate, the insulative layer on the lower substrate, and the heating elements in the lower substrate, wherein at least one of said upper substrate and said insulative layer comprises a crosslinked polymer formed by crosslinking a precursor polymer which is a phenolic novolac resin having glycidyl ether functional groups on the monomer repeat units thereof, wherein the precursor polymer is crosslinked by exposing to actinic radiation a composition comprising the precursor polymer and a cationic photoinitiator which is selected from onium salts of Group VA elements, onium salts of Group VIA elements, aromatic holonium salts, or mixtures thereof.

27. A printhead according to claim 26 wherein the photoinitiator is a sulfonium salt.

28. A printhead according to claim 26 wherein the photoinitiator is triphenylsulfonium tetrafluoroborate, methyldiphenylsulfonium tetrafluoroborate, dimethylphenylsulfonium hexafluorophosphate, triphenylsulfonium hexafluorophosphate, triphenylsulfonium hexafluoroantimonate, diphenyinaphthylsulfonium hexafluoroarsenate, tritolysulfonium hexafluorophosphate, anisyldiphenylsulfonium hexafluoroantimonate, 4-butoxyphenyidiphenylsulfonium tetrafluoroborate, 4-chlorophenyidiphenylsulfonium hexafluoroantimonate, tris(4-phenoxyphenyl)sulfonium hexafluorophosphate, di(4-ethoxyphenyl)methylsulfonium hexafluoroarsenate, 4-acetoxy-phenyidiphenylsulfonium tetrafluoroborate, tris(4-thiomethoxyphenyl)sulfonium hexafluorophosphate, di(methoxysulfonylphenyl)methylsulfonium hexafluoroantimonate, di(methoxynaptthyl)methylsulfonium tetrafluoroborate, di(carbomethoxyphenyl)methylsulfonium hexafluorophosphate, 4-acetamidophenyldiphenylsulfonium tetrafluoroborate, dimethylnaphthylsulfonium hexafluorophosphate, trifluoromethyidiphenylsulfonium tetrafluoroborate, methyl(n-methylphenothiazinyi)sulfonium hexafluoroantimonate, phenylmethylbenzylsulfonium hexafluorophosphate, or mixtures thereof.

29. A printhead according to claim 26 wherein the photoinitiator is an aromatic iodonium salt selected from diphenyllodonium tetrafluoroborate, di(4-methylphenyl)iodonium tetrafluoroborate, phenyl-4-methylphenyliodonium tetrafluoroborate, di(4-heptylphenyl)iodonium tetrafluoroborate, di(3-nitrophenyl)iodonium hexafluorophosphate, di(4-chlorophenyl)iodonium hexafluorophosphate, di(naphthyl)iodonium tetrafluoroborate, di(4-trifluoromethylphenyl)iodonium tetrafluoroborate, diphenyliodonium hexafluorophosphate, di(4-methylphenyl)iodonium hexafluorophosphate, diphenyliodonium hexafluoroarsenate, di(4-phenoxyphenyl)iodonium tetrafluoroborate, phenyl-2-thienyliodonium hexafluorophosphate, 3,5-dimethylpyrazolyl-4-phenyliodonium hexafluorophosphate, diphenyliodonium hexafluoroantimonate, 2,2'-diphenyliodonium tetrafluoroborate, di(2,4-dichlorophenyl)iodonium hexafluorophosphate, di(4-bromophenyl)iodonium hexafluorophosphate, di(4-methoxyphenyl)iodonium hexafluorophosphate, di(3-carboxyphenyl)iodonium hexafluorophosphate, di(3-methoxycarbonylphenyl)iodonium hexafluorophosphate, di(3-methoxysulfonylphenyl)iodonium hexafluorophosphate, di(4-acetamidophenyl)iodonium hexafluorophosphate, or di(2-benzoethienyl)iodonium hexafluorophosphate.

30. A printhead according to claim 26 wherein the photoinitiator is a triphenylsulfonium hexafluoroantimonate.

31. A thermal ink jet printhead which comprises: (i) an upper substrate, and (ii) a lower substrate in which one surface thereof has on array of heating elements and addressing electrodes formed thereon, said lower substrate having an insulative layer deposited on the surface thereof and over the heating elements and addressing electrodes and patterned to form recesses therethrough to expose the heating elements and terminal ends of the addressing electrodes so as to form a plurality of ink channels, said upper and lower substrates being bonded together to form a thermal ink jet printhead having droplet emitting nozzles defined by the upper substrate, the insulative layer on the lower substrate, and the heating elements in the lower substrate, wherein at least one of said upper substrate and said insulative layer comprises a crosslinked polymer formed by crosslinking a precursor polymer which is a phenolic novolac resin having glycidyl ether functional groups on the monomer repeat units thereof, wherein the precursor polymer is crosslinked by exposing to actinic radiation a composition comprising the precursor polymer, a cationic photoinitiator, and a solvent.

32. A printhead according to claim 31 wherein the solvent is selected from the group consisting of γ-butyrolactone, propylene glycol methyl ether acetate, tetrahydrofuran, methyl ethyl ketone, methyl isobutyl ketone, and mixtures thereof.

33. A thermal ink jet printhead which comprises: (i) an upper substrate, and (ii) a lower substrate in which one surface thereof has an array of heating elements and addressing electrodes formed thereon, said lower substrate having an insulative layer deposited on the surface thereof and over the heating elements and addressing electrodes and patterned to form recesses therethrough to expose the heating elements and terminal ends of the addressing electrodes so as to form a plurality of ink channels, said upper and lower substrates being bonded together to form a thermal ink jet printhead having droplet emitting nozzles defined by the upper substrate, the insulative layer on the lower substrate, and the heating elements in the lower substrate, wherein at least one of said upper substrate and said insulative layer comprises a crosslinked polymer formed by crosslinking a precursor polymer which is a phenolic novolac resin having glycidyl ether functional groups on the monomer repeat units thereof, wherein a first set of nozzles eject droplets with volumes of no more than about 5 picoliters and a second set of nozzles eject droplets with volumes of no less than about 20 picoliters.

* * * * *